US007668470B2

(12) United States Patent
Tsuji et al.

(10) Patent No.: US 7,668,470 B2
(45) Date of Patent: Feb. 23, 2010

(54) TONER SUPPLYING METHOD, TONER SUPPLYING DEVICE, DEVELOPING DEVICE, AND IMAGE FORMING APPARATUS WITH CONTROLLED TONER SUPPLY

(75) Inventors: Akiko Tsuji, Kameyama (JP); Shuhichi Morikuni, Nara (JP); Takahiko Kimura, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 519 days.

(21) Appl. No.: 11/700,891

(22) Filed: Feb. 1, 2007

(65) Prior Publication Data

US 2007/0217798 A1 Sep. 20, 2007

(30) Foreign Application Priority Data

Mar. 20, 2006 (JP) ..... 2006-077795

(51) Int. Cl.
*G03G 15/08* (2006.01)

(52) U.S. Cl. ..... 399/27; 399/258

(58) Field of Classification Search ..... 399/27, 399/258

See application file for complete search history.

(56) References Cited

U.S. PATENT DOCUMENTS 5,652,947 A * 7/1997 Izumizaki ..... 399/258
6,795,660 B2 * 9/2004 Yugeta et al. ..... 399/27
7,110,707 B2 * 9/2006 Nishitani ..... 399/258
7,269,364 B2 * 9/2007 Tanaka et al. ..... 399/27
7,421,216 B2 * 9/2008 Onda et al. ..... 399/27
2003/0210929 A1 11/2003 Ota et al.

FOREIGN PATENT DOCUMENTS

| | | |
|---|---|---|
| JP | 62-050778 | 3/1987 |
| JP | 63-168458 | 11/1988 |
| JP | 11-295975 | 10/1999 |
| JP | 2001-255727 | 9/2001 |
| JP | 2004-347794 A | 12/2004 |
| JP | 2006-47777 A | 2/2006 |

* cited by examiner

*Primary Examiner*—William J Royer
(74) *Attorney, Agent, or Firm*—Nixon & Vanderhye, P.C.

(57) ABSTRACT

A toner supplying device includes: a toner density sensor for detecting a density of toner contained in a developer tank; a toner hopper for supplying toner to the developer tank; a toner cartridge for supplying toner to the toner hopper; and a control section, when a request to supply toner to the developer tank is made in accordance with a signal detected by the toner density sensor, for controlling a hopper driving motor and a cartridge driving motor so that (i) the toner hopper supplies toner to the developer tank and (ii) the toner cartridge supplies toner to the toner hopper. Thus, in a structure having first and second toner supplying sections disposed on top of each other, toner can be stably supplied to a developer tank.

17 Claims, 26 Drawing Sheets

TONER SUPPLYING METHOD, TONER SUPPLYING DEVICE, DEVELOPING DEVICE, AND IMAGE FORMING APPARATUS WITH CONTROLLED TONER SUPPLY

This Nonprovisional application claims priority under 35 U.S.C. § 119(a) on Patent Application No. 077795/2006 filed in Japan on Mar. 20, 2006, the entire contents of which are hereby incorporated by reference.

FIELD OF THE INVENTION

The technology disclosed herein relates to a toner supplying method, a toner supplying device, a developing device, and an image forming apparatus by which or in which toner serving as a developer is supplied to a developer tank.

BACKGROUND OF THE INVENTION

Conventionally, electrophotographic image forming apparatuses such as copiers, printers, and facsimile machines have been known. The electrophotographic method makes it possible to easily form a high-quality image, and therefore has been widely adopted by the various image forming apparatuses.

Generally, an image forming apparatus adopting the electrophotographic method carries out the following operations. Specifically, a surface of a photoreceptor containing a photoconductive substance is uniformly charged. The photoreceptor's surface thus charged is irradiated with light that is based on image information, so that an electrostatic latent image is formed. The electrostatic latent image thus formed is visualized by supplying toner to the electrostatic latent image, so that a toner image is obtained. The toner image thus obtained is transferred from the photoreceptor onto a recording medium. The toner image thus transferred onto the recording medium is fixed to the recording medium by heat, pressure, and the like.

Toner to be used for developing the electrostatic latent image is supplied from a developing device to the surface of the photoreceptor. The developing device includes a developer tank. The developer tank contains toner, and has a developing roller, a doctor blade, and a stirring roller. The developing roller is provided so as to make contact with the surface of the photoreceptor, has a surface on which a toner layer is carried, and supplies toner to the electrostatic latent image. The doctor blade includes a plate member provided so as to make contact with the surface of the developing roller, and regulates the thickness of the toner layer carried on the surface of the developing roller. The stirring roller carries out a rotation operation, so that (i) the toner is charged and (ii) the toner thus charged is supplied to an area surrounding the developing roller.

The developing device further includes a toner hopper serving as a toner supplying device. The toner hopper is designed to supply toner to the developer tank.

For example, in Patent Document 1 (Japanese Unexamined Utility Model Publication No. 168458/1988 (Jitsukaisho 63-168458; published on Nov. 2, 1988)), a plurality of toner amount sensors are provided on a side wall of a supplying tank (toner hopper) so as to be on top of one another, and a supplying roller is provided in a toner-supplying opening via which toner is supplied from the supplying tank. Moreover, the rotation speed of the supplying roller is controlled in accordance with the amount of toner remaining in the supplying tank which amount is detected by the plurality of toner amount sensors.

Further, in Patent Document 2 (Japanese Unexamined Patent Publication No. 50778/1987 (Tokukaisho 62-50778; published on March 5)), a toner density sensor is provided in a developer tank, and a toner supplying roller is provided in a toner-supplying opening of a toner tank (toner hopper). Moreover, the rotation of the toner supplying roller is controlled in accordance with a result of detection carried out by the toner density sensor.

Meanwhile, in recent years, a toner supplying device including a toner cartridge has been commonly used for the purpose of increasing the level of convenience in supplying toner to a developer tank. According to such a developing device, as described in Patent Document 3 (Japanese Unexamined Patent Publication No. 255727/2001 (Tokukai 2001-255727; published on Sep. 21, 2001)) and Patent Document 4 (Japanese Unexamined Patent Publication No. 295975/1999 (Tokukaihei 11-295975; published on Oct. 29, 1999)), the toner cartridge supplies toner to a toner hopper, and the toner hopper supplies toner to the developer tank. In this case, the toner hopper functions as an adjuster by which toner supplied from the toner cartridge is smoothly supplied to the developer tank by appropriate amounts. Further, for the purpose of miniaturization of a developing device, a typical toner hopper is small, and can contain only a small amount of toner. On the other hand, for the purpose of reducing exchange frequency, a typical toner cartridge is larger than a typical toner hopper, and contains a larger amount of toner than does a typical toner hopper.

According to such a developing device, as described in Patent Document 3, a developer container (developer tank) is provided with a toner density sensor, and a toner hopper is provided with a remaining toner amount sensor. Moreover, when a shortage in toner in the toner hopper is detected by the remaining toner amount sensor, the toner cartridge supplies toner to the toner hopper. When a shortage in toner in the developer tank is detected by the toner density sensor, the toner hopper supplies toner to the developer container.

See a case where a two-step toner supplying device, in which, as described above, a toner cartridge (first toner supplying means) supplies toner to a toner hopper (second toner supplying means) and the toner hopper supplies toner to a developer tank, is arranged such that, as described above, the toner cartridge supplies toner to the toner hopper in accordance with a result of detection carried out by the remaining toner amount sensor of the toner hopper. In this case, toner may not be smoothly supplied to the developer tank. That is, slow detection of a correct remaining amount of toner or false detection of a remaining amount of toner may be caused depending on (i) a location at which the remaining toner amount sensor is disposed in the toner hopper, (ii) a direction in which toner is flowed, and (iii) the like. Alternatively, in cases where a large amount of toner is consumed for the purpose of printing a document having a high coverage rate or continuously carrying out a large amount of printing, the toner cartridge may supply toner to the toner hopper belatedly. In such a case, the density of toner contained in the developer tank becomes insufficient, and this causes a developing device to have a problem in carrying out a development operation. Such a problem becomes significant especially in an arrangement in which the toner hopper is miniaturized for the purpose of miniaturizing the device.

Therefore, it is an object of the technology described herein to provide a toner supplying method, a toner supplying device, a developing device, and an image forming apparatus each of which makes it possible to stably supply toner to a developer tank in an arrangement in which first and second toner supplying means disposed on top of each other are provided.

SUMMARY OF THE INVENTION

A toner supplying device of the technology described herein includes: a toner density sensor for detecting a toner density in a developer tank; a first toner supplying section for supplying toner to the developer tank; a second toner supplying section for supplying toner to the first toner supplying section; and control section, when a request to supply toner to the developer tank is made in accordance with a signal detected by the toner density sensor, for controlling the first toner supplying section and the second toner supplying section so that (i) the first toner supplying section supplies toner to the developer tank and (ii) the second toner supplying section supplies toner to the first toner supplying section.

Further, a toner supplying method of the technology described herein is a method for supplying toner from a first toner supplying section to a developer tank, and for supplying toner from a second toner supplying section to the first toner supplying section, the method, including the step of: when a shortage in toner density in the developer tank is detected, (i) causing the first toner supplying section to supply toner to the developer tank and (ii) causing the second toner supplying section to supply toner to the first toner supplying section.

According to the foregoing arrangement, in cases where a shortage in toner density in the developer tank is detected, the first toner supplying section supplies toner to the developer tank and the second toner supplying section supplies toner to the first toner supplying section. Therefore, the supply of toner from the second toner supplying section to the first toner supplying section is not carried out depending on a result of detection carried out by a remaining toner amount sensor provided for example in the first toner supplying section, but is carried out in cases where a shortage in toner density in the developer tank is detected, i.e., in cases where the first toner supplying section supplies toner to the developer tank.

Thus, even when the first toner supplying section has a small size and a small capacity, belated supply of toner from the second toner supplying section to the first toner supplying section is prevented, so that there is no shortage in remaining toner amount in the first toner supplying section. This makes it possible to stably supply toner from the first toner supplying section to the developer tank.

Additional objects, features, and strengths of the technology described herein will be made clear by the description below. Further, the advantages of the technology described herein will be evident from the following explanation in reference to the drawings.

BRIEF DESCRIPTION OF THE DRAWINGS

FIG. 9 (*b*) is a longitudinal sectional view of the pipe portion shown in FIG. 9(*a*).

FIG. 17(*b*) is a perspective view of the toner cartridge shown in FIG. 3.

FIG. 22(*b*) is a perspective view of a second housing constituting the bottle supporting member shown in FIG. 21.

FIG. 26(*b*) is an explanatory diagram showing a state in which the shutter member is closed in the toner cartridge shown in FIGS. 17(*a*) and 17(*b*).

DESCRIPTION OF THE EMBODIMENTS

An embodiment of the technology described herein will be described below. In the present embodiment, an example is explained in which a toner supplying device of the technology described herein is applied to a printer, which is a type of image forming apparatus.

Figure 2:
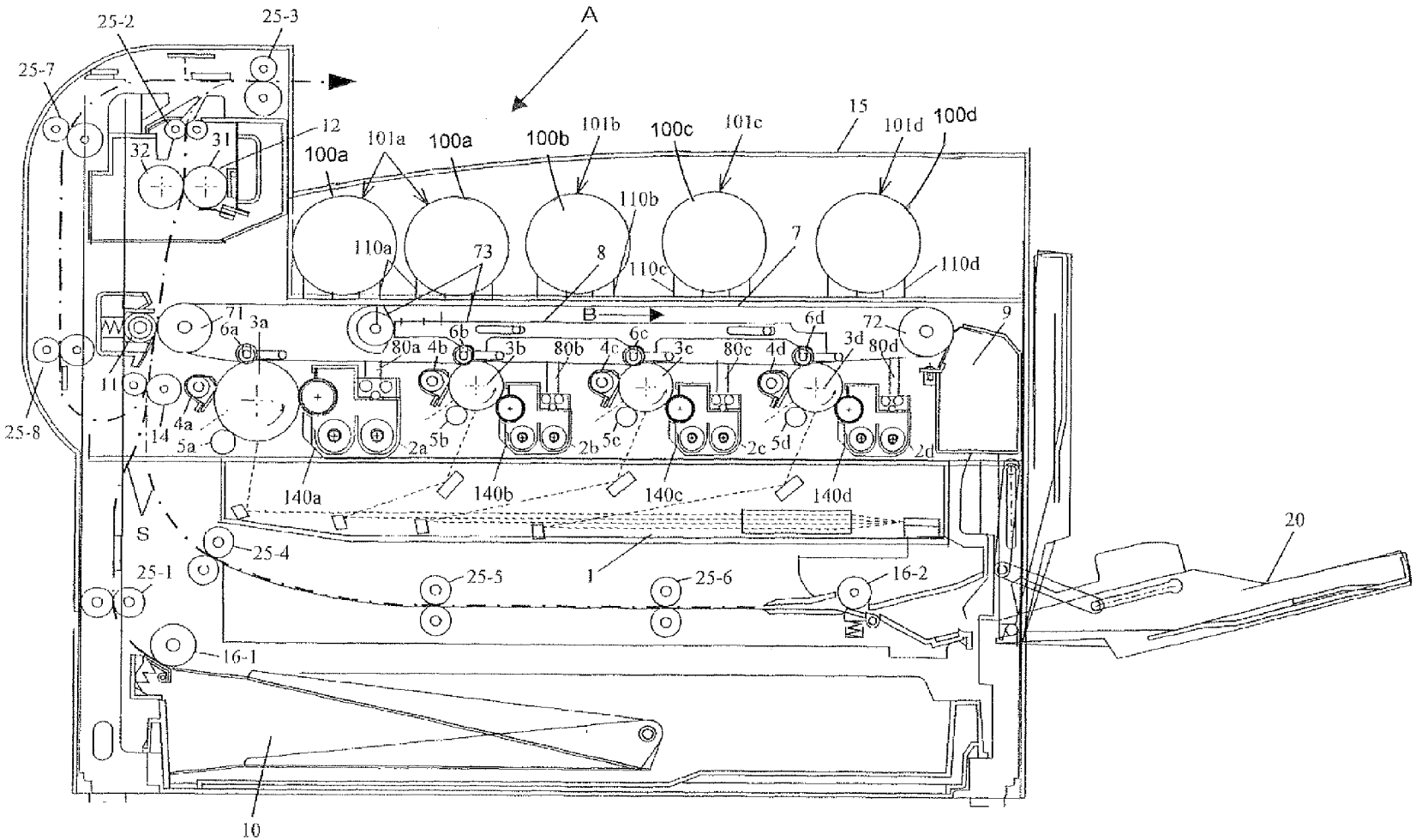
FIG. 2 is a front view showing an inner structure of a printer including the developing device shown in FIG. 1.

FIG. 2 is a diagram schematically showing an arrangement of a printer according to the present embodiment. The printer A forms, in accordance with image data transmitted from outside, a monochrome or multicolor image on a predetermined sheet (recording paper sheet). As shown in FIG. 2, the printer A includes an exposure unit 1, developing devices 2 (2*a*, 2*b*, 2*c*, 2*d*), photoreceptor drums 3 (3*a*, 3*b*, 3*c*, 3*d*), chargers 5 (5*a*, 5*b*, 5*c*, 5*d*), cleaner units 4 (4*a*, 4*b*, 4*c*, 4*d*), an intermediate transfer belt unit 8, a fixing device 12, a paper sheet transportation path S, a paper sheet feeding tray 10, a paper sheet discharging tray 15, and the like.

The image data to be processed in the printer A corresponds to a color image made up of four colors: black (K), cyan (C), magenta (M), and yellow (Y). Accordingly, the printer A is provided with four image stations. The four image stations form four types of latent image corresponding to the four colors, respectively. An image station corresponding to black (K) includes the developing device 2*a*, the photoreceptor drum 3*a*, the charger 5*a*, and the cleaner unit 4*a*. An image station corresponding to cyan (C) includes the developing device 2*b*, the photoreceptor drum 3*b*, the charger 5*b*, and the cleaner unit 4*b*. The image station corresponding to magenta (M) includes the developing device 2*c*, the photoreceptor drum 3*c*, the charger 5*c*, and the cleaner unit 4*c*. The image station corresponding to yellow (Y) includes the developing device 2*d*, the photoreceptor drum 3*d*, the charger 5*d*, and the cleaner unit 4*d*.

The photoreceptor drums 3 are provided (installed) in an upper portion of the printer A so as to form an electrostatic latent image in accordance with the image data.

The chargers 5 serve as charging means for uniformly charging surfaces of the photoreceptor drums 3 at predetermined potentials, respectively. See FIG. 2. Each of the chargers 5 may be, e.g., a contact-roller-type charger, a brush-type charger, and a discharge-type charger.

As shown in FIG. 2, the exposure unit 1 may be a laser scanning unit (LSU) including a laser irradiation section and a reflective mirror. Alternatively, the exposure unit 1 may be an EL or LED writing head including light-emitting elements arranged in an array manner.

The exposure unit 1 has a function of exposing the electrified photoreceptor drums 3 in accordance with the input image data. With this, electrostatic latent images are respectively formed on the surfaces of the photoreceptor drums 3 in accordance with the image data.

The developing devices 2 visualize, with toner (black (K), cyan (C), magenta (M), yellow (Y)), the electrostatic latent images formed on the photoreceptor drums 3, respectively. After the image is developed and transferred, some toner remaining on the respective surfaces of the photoreceptor drums 3 is removed and collected by the cleaner units 4.

The intermediate transfer belt unit 8 provided above the photoreceptor drums 3 includes an intermediate transfer belt 7, an intermediate transfer belt driving roller 71, an intermediate transfer belt tension mechanism 73, an intermediate transfer belt driven roller 72, intermediate transfer rollers 6 (6*a*, 6*b*, 6*c*, 6*d*), and an intermediate transfer belt cleaning unit 9.

The intermediate transfer belt 7 is stretched and provided on and across the intermediate transfer belt driving roller 71, the intermediate transfer belt tension mechanism 73, the intermediate transfer rollers 6, the intermediate transfer belt driven roller 72, and the like, and is also driven to rotate in the direction indicated by an arrow B.

The intermediate transfer rollers 6 are rotatably supported in intermediate transfer roller installation parts of the intermediate transfer belt tension mechanism 73 of the intermediate transfer belt unit 8, respectively. The intermediate transfer rollers 6 give transfer bias for transferring respective toner images of the photoreceptor drums 3 onto the intermediate transfer belt 7.

The intermediate transfer belt 7 is provided so as to make contact with each of the photoreceptor drums 3. The toner images which respectively have the four colors and which are formed respectively on the photoreceptor drums 3 are transferred onto the intermediate transfer belt 7 so as to be sequentially superimposed on one another. With this, a color toner image (multicolor toner image) is formed on the intermediate transfer belt 7. The intermediate transfer belt 7 is made of a film having a thickness of approximately 100 μm to 150 μm, and has no ends.

The transfer of the toner images from the photoreceptor drums 3 onto the intermediate transfer belt 7 is carried out by the intermediate transfer rollers 6 making contact with a back side of the intermediate transfer belt 7. To each of the intermediate transfer rollers 6, a high-voltage transfer bias (high voltage whose polarity (+) is reverse to the charging polarity (−) of the toner) is applied for the purpose of transferring the toner images.

The intermediate transfer roller 6 has, as its base, a metal (e.g., stainless-steel) shaft having a diameter of 8 mm to 10 mm. The intermediate transfer roller 6 has a surface covered with an electrically-conductive elastic material (e.g., EPDM and urethane foam). Such an electrically-conductive elastic material enables the intermediate transfer roller 6 to apply the high voltage uniformly to the intermediate transfer belt 7. The intermediate transfer roller 6 employs a roller-type transfer electrode in the present embodiment, but may employ a brush-type transfer electrode instead.

The electrostatic latent images which are formed respectively on the photoreceptor drums 3 and which are visualized respectively in accordance with the colors are superimposed on the intermediate transfer belt 7 so as to become the image information sent to the apparatus. The image information thus obtained by the superimposition is sent, by the rotation of the intermediate transfer belt 7, to a position where a below-mentioned paper sheet comes into contact with the intermediate transfer belt 7. Then, the image information is transferred onto the paper sheet by a transfer roller 11 provided in the position.

In this case, the intermediate transfer belt 7 and the transfer roller 11 are pressed against each other so that a predetermined nip is formed between the intermediate transfer belt 7 and the transfer roller 11. To the transfer roller 11, a voltage (high voltage whose polarity (+) is reverse to the charging polarity (−) of the toner) for transferring the toner to the recording paper sheet is applied.

Furthermore, while either one of the transfer roller 11 and the intermediate transfer belt driving roller 71 is made of a hard material (e.g., metal), the other is made of a soft material (e.g., elastic rubber or resin foam). With this, the nip can be constantly obtained.

Further, as described above, the toner adheres to the intermediate transfer belt 7 as the result of the contact of the intermediate transfer belt 7 with the photoreceptor drums 3, or the toner is not transferred onto the sheet by the transfer roller 11 and accordingly remains on the intermediate transfer belt 7. Such toner causes a mixture of the colors of toner in the next step. Therefore, the toner is removed and collected by the intermediate transfer belt cleaning unit 9.

The intermediate transfer belt cleaning unit 9 includes, e.g., a cleaning member which makes contact with the intermediate transfer belt 7. Examples of the cleaning member include a cleaning blade. The intermediate transfer belt 7 making contact with the cleaning blade is supported by the intermediate transfer belt driven roller 72 so that the back side of the intermediate transfer belt 7 makes contact with the intermediate transfer belt driven roller 72.

The paper sheet feeding tray 10 serves as a tray for storing sheets (recording paper sheets) used for image formation. The paper sheet feeding tray 10 is provided below the image forming section and the exposure unit 1 of the printer A.

Further, the paper sheet discharging tray 15 serves as a tray for loading printed sheets in a face-down manner, i.e., in such a manner that printed sides of the sheets face down. The paper sheet discharging tray 15 is provided in an upper portion of the printer A.

Further, the printer A is provided with the paper sheet transportation path S for sending the sheets from the paper sheet feeding tray 10 to the paper sheet discharging tray 15 via the transfer roller 11 and the fixing device 12. The paper sheet transportation path S extends substantially vertically. Furthermore, provided near the paper sheet transportation path S extending from the paper sheet feeding tray 10 to the paper sheet discharging tray 15 are a pickup roller 16-1, a resist roller 14, the transfer roller 11, the fixing device 12, and transportation rollers 25 (25-1, 25-2, 25-3) for transporting the sheets.

Each of the transportation rollers 25 is a small roller for facilitating/assisting the transportation of the sheets. The transportation rollers 25 are provided along the paper sheet transportation path S.

The pickup roller 16-1 is a feeding roller provided on one end of the paper sheet feeding tray 10 so as to supply the sheets one by one to the paper sheet transportation path S.

The resist roller 14 temporarily suspends the transportation of each of the sheets via the paper sheet transportation path S. At such a timing that the head of the sheet is aligned with the head of each of the toner images on the photoreceptor drums 3, the resist roller 14 transports the sheet to a transfer section.

The fixing device 12 includes a heat roller 31 and a pressure roller 32. The heat roller 31 and the pressure roller 32 rotate with the sheet sandwiched therebetween. The heat roller 31 is controlled by a control section in accordance with a signal from a temperature detector (not shown) so as to be set at a predetermined fixing temperature. The sheet between the heat roller 31 and the pressure roller 32 is subjected to heat and pressure. This causes melting and mixing of the multicolor toner image, transferred onto the sheet, with the result that the multicolor toner image is pressed and fixed by heat on the sheet.

The paper sheet having the multicolor toner image fixed thereon is transported by the transportation rollers 25 to a reverse paper sheet discharging path of the paper sheet transportation path S, and then is discharged onto the paper sheet discharging tray 15 in a reversed manner (i.e., in such a manner that the multicolor toner image faces down).

The following explains in detail the sheet transportation path S. The printer A is provided with not only the paper sheet feeding tray 10 for preliminarily storing the sheets, but also a manual paper sheet feeding tray 20 allowing a user to print a small number of sheets without opening and closing the paper sheet feeding tray 10. The pickup roller 16-1 is provided in the paper sheet feeding tray 10 so as to feed the sheets one by one to the paper sheet transportation path S. On the other hand, a pickup roller 16-2 is provided in the manual paper sheet feeding tray 20 so as to feed the sheets one by one to the paper sheet transportation path S.

Each of the sheets transported from the paper sheet feeding tray 10 is transported to the resist roller 14 by a transportation roller 25-1 provided in the paper sheet transportation path S. At such a timing that the head of the sheet is aligned with the head of the image information on the intermediate transfer belt 7, the sheet is transported to the transfer roller 11 so that the image information is written on (transferred onto) the sheet. Thereafter, the sheet is brought to the fixing device 12 so that the toner yet to be fixed on the sheet is melted and fixed by heat on the sheet. The sheet is discharged by the transportation roller 25-3, serving also as a paper sheet discharging roller, to the paper sheet discharging tray 15 via the transportation roller 25-2. Note that this is a case of single-side printing.

On the other hand, each of the sheets loaded on the manual paper sheet feeding tray 20 is fed by the pickup roller 16-2, and then reaches the resist roller 14 via a plurality of transportation rollers (25-6, 25-5, 25-4). Thereafter, the sheet is discharged to the paper sheet discharging tray 15 after being subjected to the same process as the sheet fed from the paper sheet feeding tray 10. Note that this is the case of single-side printing.

On the other hand, see a case where double-side printing is required on this occasion. After the sheet subjected to the single-side printing passes through the fixing device 12, the back end of the sheet is clamped by the transportation roller 25-3. The transportation roller 25-3 rotates in a reverse direction so as to guide the sheet to transportation rollers (25-7, 25-8). Thereafter, the sheet is subjected to back-side printing after passing through the resist roller 14, and then is discharged to the paper sheet discharging tray 15.

The developing devices 2 (2*a*, 2*b*, 2*c* 2*d*) include developer tanks 140 (140*a*, 140*b*, 140*c*, 140*d*), respectively. Further, in order to be able to process a large amount of printing at a high speed, the developing devices 2 (2*a*, 2*b*, 2*c*, 2*d*) includes toner supplying devices 101 (101*a*, 101*a*, 101*b*, 101*c*, 101*d*) for supplying toner to the developer tanks 140 (140*a*, 140*b*, 140*c*, 140*d*), respectively. The toner supplying devices (101*a*, 101*a*, 101*b*, 101*c*, 101*d*) include toner cartridges 100 (100*a*, 100*a*, 100*b*, 100*c*, 100*d*), toner hoppers 110 (110*a*, 110*a*, 110*b*, 110*c*, 110*d*), and supplying pipes 80 (80*a*, 80*b*, 80*c*, 80*d*), respectively.

Each of the toner cartridges 100*a* contains black (K) toner as supplementary toner. Similarly, the toner cartridges 100*b*, 100*c*, and 100*d* contain cyan (C) toner, magenta (M) toner, and yellow (Y) toner, respectively.

Figure 3:
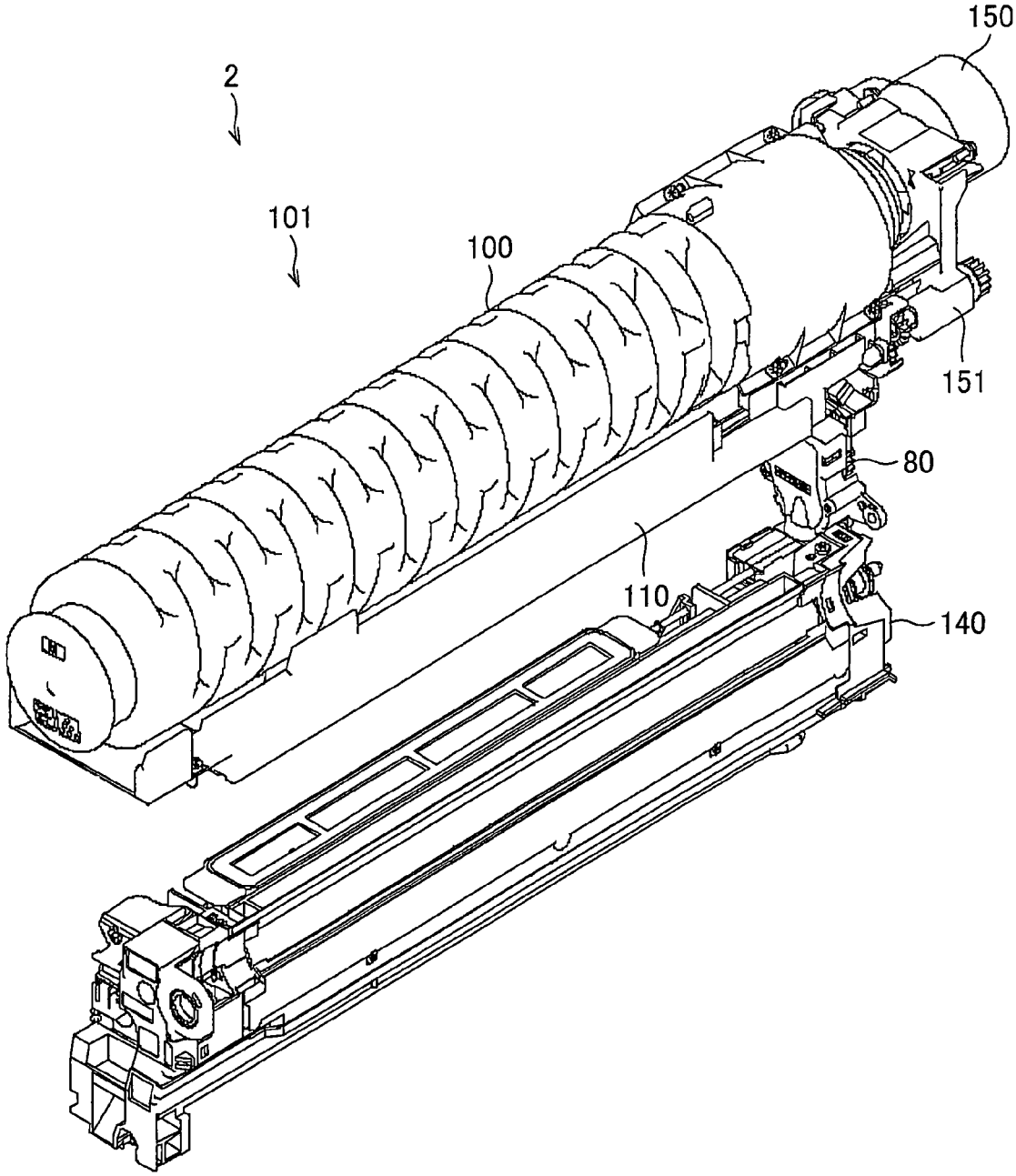
FIG. 3 is a perspective view of the developing device shown in FIG. 1.

As shown in FIG. 3, a toner supplying device 101 is provided directly above a developer tank 140. The toner supplying device 101 is arranged such that a toner cartridge 100 is provided on top of a toner hopper 110. The toner hopper 110 is connected to the developer tank 140 by a supplying pipe 80 extending from top to bottom. Supply of toner from the toner cartridge 100 to the toner hopper 110 and supply of toner from the toner hopper 110 to the developer tank 140 via the supplying pipe 80 are carried out on an end portion side on which the supplying pipe 80 is provided. The toner cartridge 100 is driven by a cartridge driving motor 150, and the toner hopper 110 is driven by a hopper driving motor 151.

Further, the intermediate transfer belt unit 8 is provided between the toner cartridge 100 and the toner hopper 110. The supplying pipe 80*a* for supplying black (K) toner is structured such that: developers respectively contained in the two toner cartridges 100*a* are combined, and then are supplied to the toner hopper 110*a*, i.e., to the developer tank 140*a*.

Figure 4:
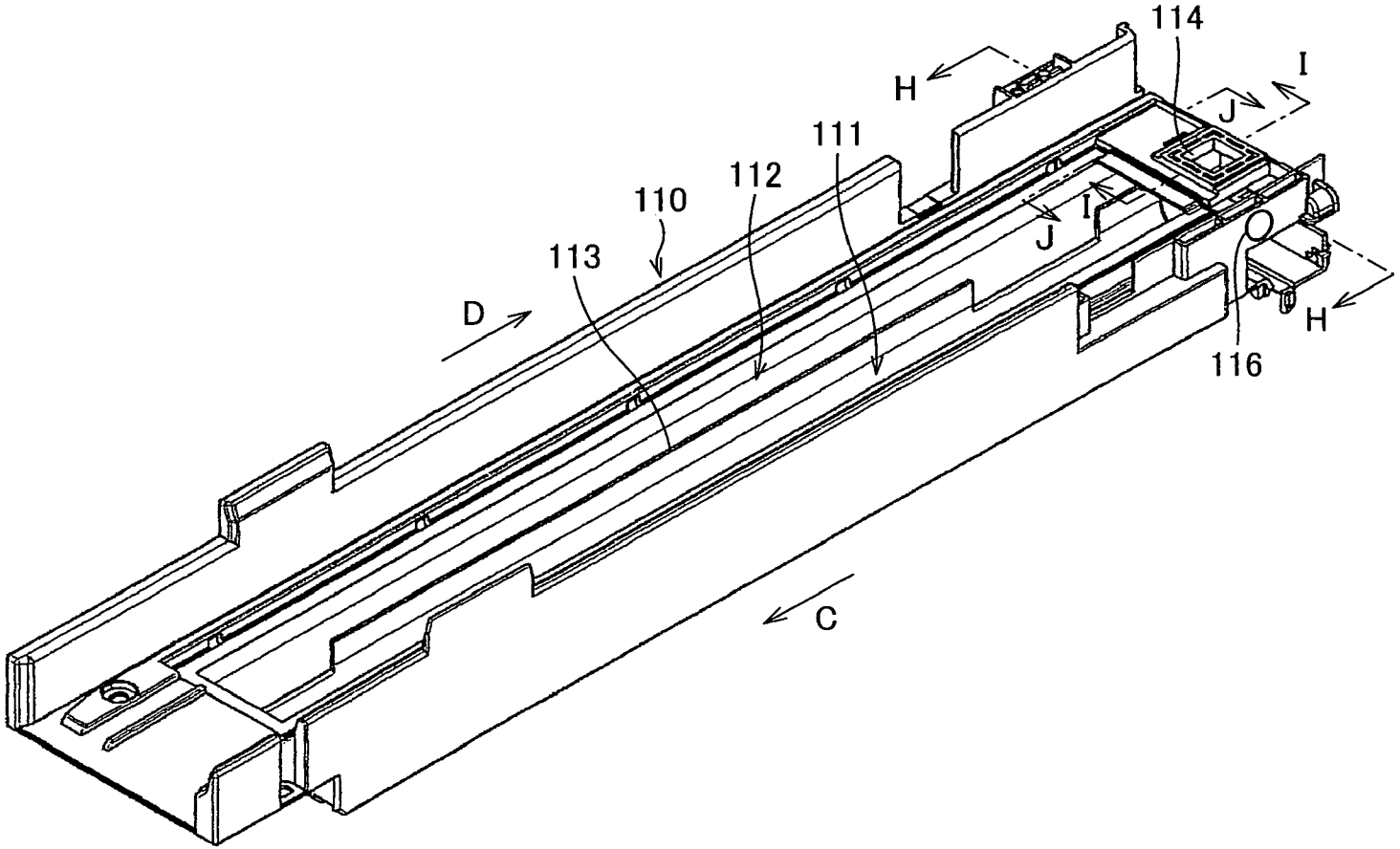
FIG. 4 is a perspective view of a toner hopper shown in FIG. 1.
Figure 5:
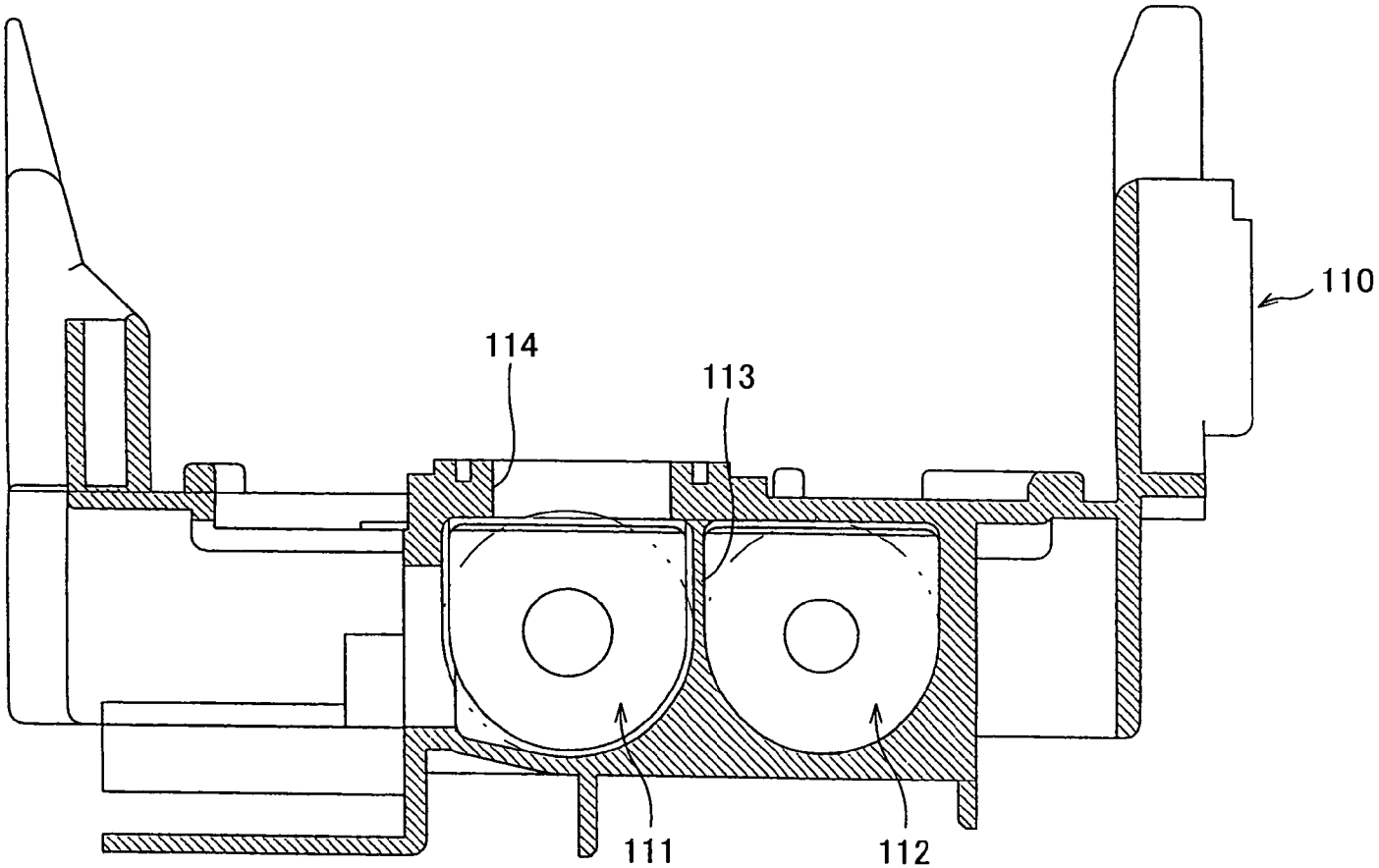
FIG. 5 is a cross-sectional view taken along the arrow H-H of FIG. 4.
Figure 6:
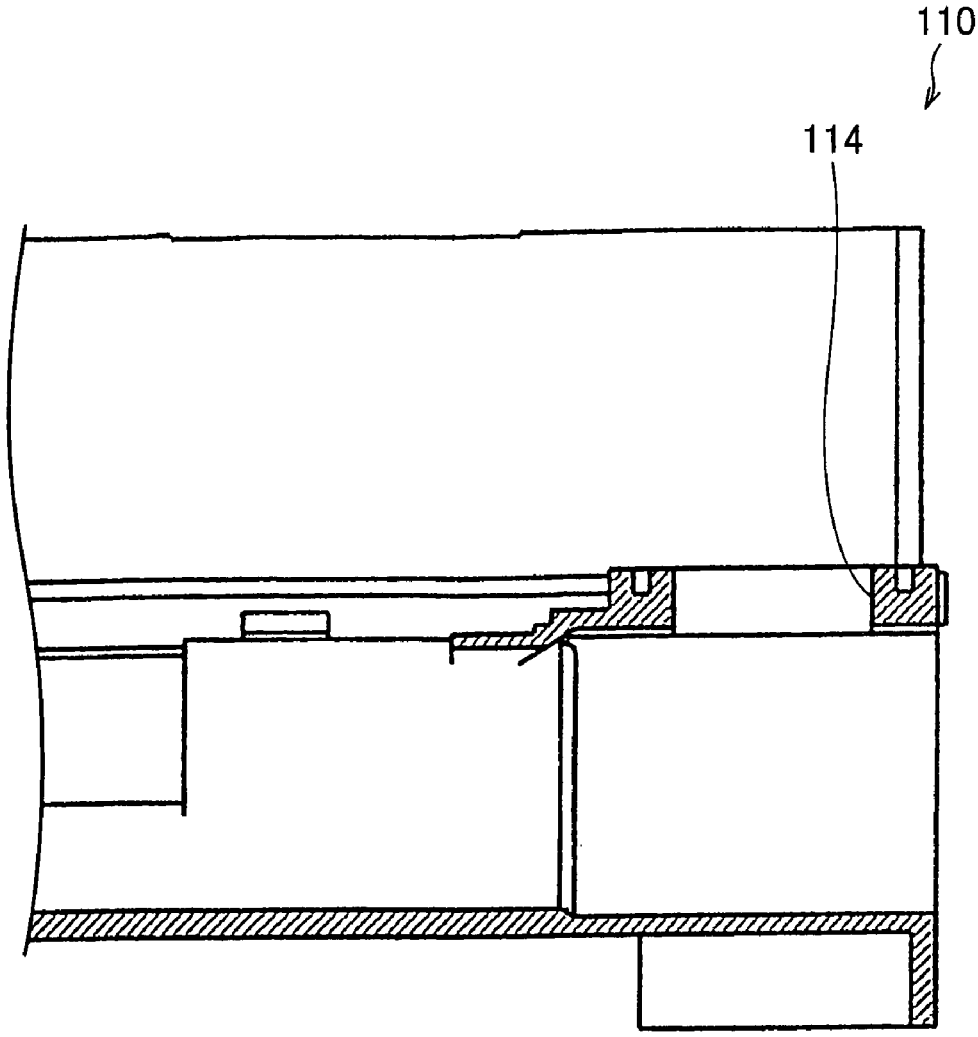
FIG. 6 is a cross-sectional view taken along the arrow I-I of FIG. 4.
Figure 7:
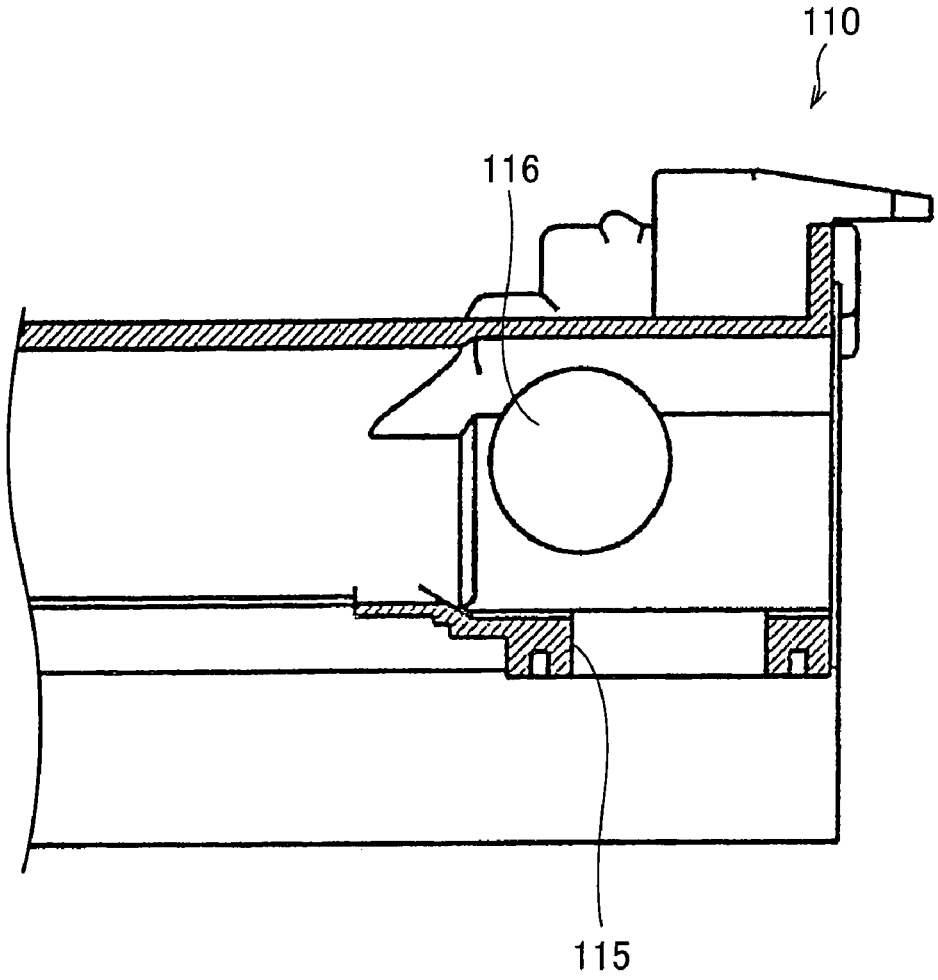
FIG. 7 is a cross-sectional view taken along the arrow J-J of FIG. 4.

The toner hopper 110 of the toner supplying devices 101 has a structure shown in FIGS. 4 through 7. FIG. 4 is a perspective view of the toner hopper 110. FIG. 5 is a cross-sectional view taken along an arrow H-H of FIG. 4. FIG. 6 is a cross-sectional view taken along an arrow I-I of FIG. 4. FIG. 7 is a cross-sectional view taken along an arrow J-J of FIG. 4. As shown in FIG. 4, the toner hopper 110 includes two toner transportation paths, namely a first toner transportation path 111 and a second toner transportation path 112. The first and second toner transportation paths 111 and 112 are divided by a divider plate 113. Each of the first and second toner transportation paths 111 and 112 has an elongate shape. The first and second toner transportation paths 111 and 112 are connected to each other at an end edge portion of a direction (direction C) in which toner is transported via the first toner transportation path 111.

Provided above a beginning edge portion of the first toner transportation path 111 is a toner inlet 114 via which toner supplied from the toner cartridge 100 is introduced into the toner hopper 110. Further, as shown in FIG. 7, provided in a bottom wall portion below an end edge portion of a direction (direction D) in which toner is transported via the second toner transportation path 112 is a toner outlet 115 via which toner is inputted to the supplying pipe 80.

Further, provided in a side wall portion near the toner inlet 114 of the first toner transportation path 111 is a remaining toner amount sensor 116 for detecting the presence of toner in that region.

Figure 8:
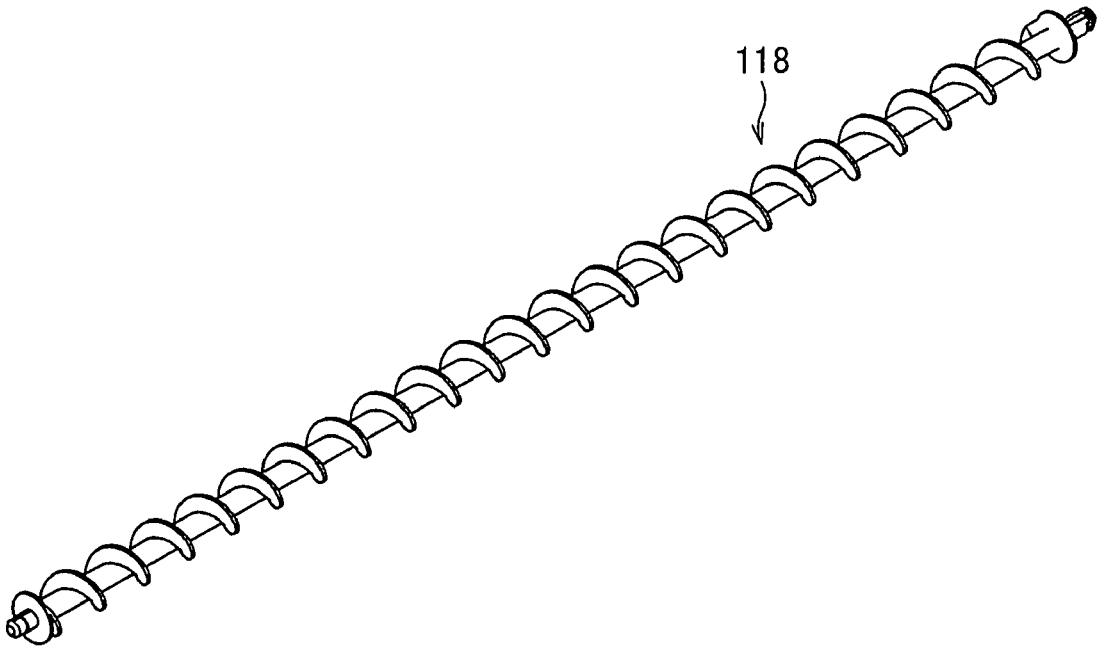
FIG. 8 is a perspective view of a toner transporting screw of the toner hopper shown in FIG. 4.

Each of the first and second toner transportation paths 111 and 112 is provided with a toner transporting screw 118 shown in FIG. 8. Therefore, toner supplied to the toner hopper 110 via the toner inlet 114 is transported in the direction C via the first toner transportation path 111 by the toner transporting screw 118, and is transferred to the second toner transportation path 112 via the end edge portion of the first toner transportation path 111. The toner is transported in the direction D via the second toner transportation path 112 by the toner transporting screw 118, and then is dropped into the supplying pipe 80 via the toner outlet 115.

Thus, in the toner supplying device 101, the toner supplied from the toner cartridge 100 to the toner hopper 110 is transported in the horizontal directions via the first toner transportation path 111 and the second toner transportation path 112, and then is supplied to the developer tank 140 via the supplying pipe 80.

In the present embodiment, the toner hopper 110 can contain only a small amount of toner, e.g., 30 g of toner. With this amount of toner, a 6% solid image can be printed on approximately 1000 A4 paper sheets.

Figure 9:
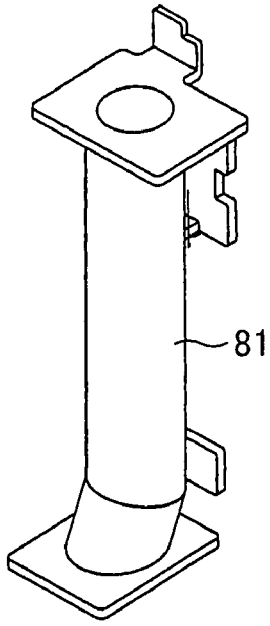
FIG. 9(*a*) is a perspective view of a pipe portion of a supplying pipe shown in FIG. 1.
Figure 9:
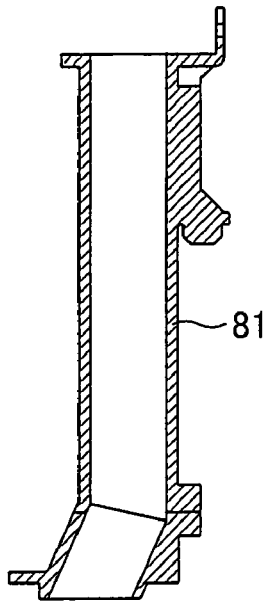

Specifically, the supplying pipe 80 has a circular pipe portion 81 shown in FIGS. 9(*a*) and 9(*b*). FIG. 9(*a*) is a perspective view of the pipe portion 81, and FIG. 9(*b*) is a longitudinal sectional view of the pipe portion 81.

The toner cartridge 100 shown in FIG. 3 is a rotary toner bottle type, and therefore supplies toner to the supplying pipe 80 while being rotated. The toner cartridge 100 of this type makes it possible to easily and accurately control the amount of toner to be supplied, and therefore is suitable to a structure using the toner hopper 110 which has a small capacity and in which toner is transported via the narrow transportation paths (first and second toner transportation paths 111 and 112). The toner cartridge 100 will be fully described later.

Figure 1:
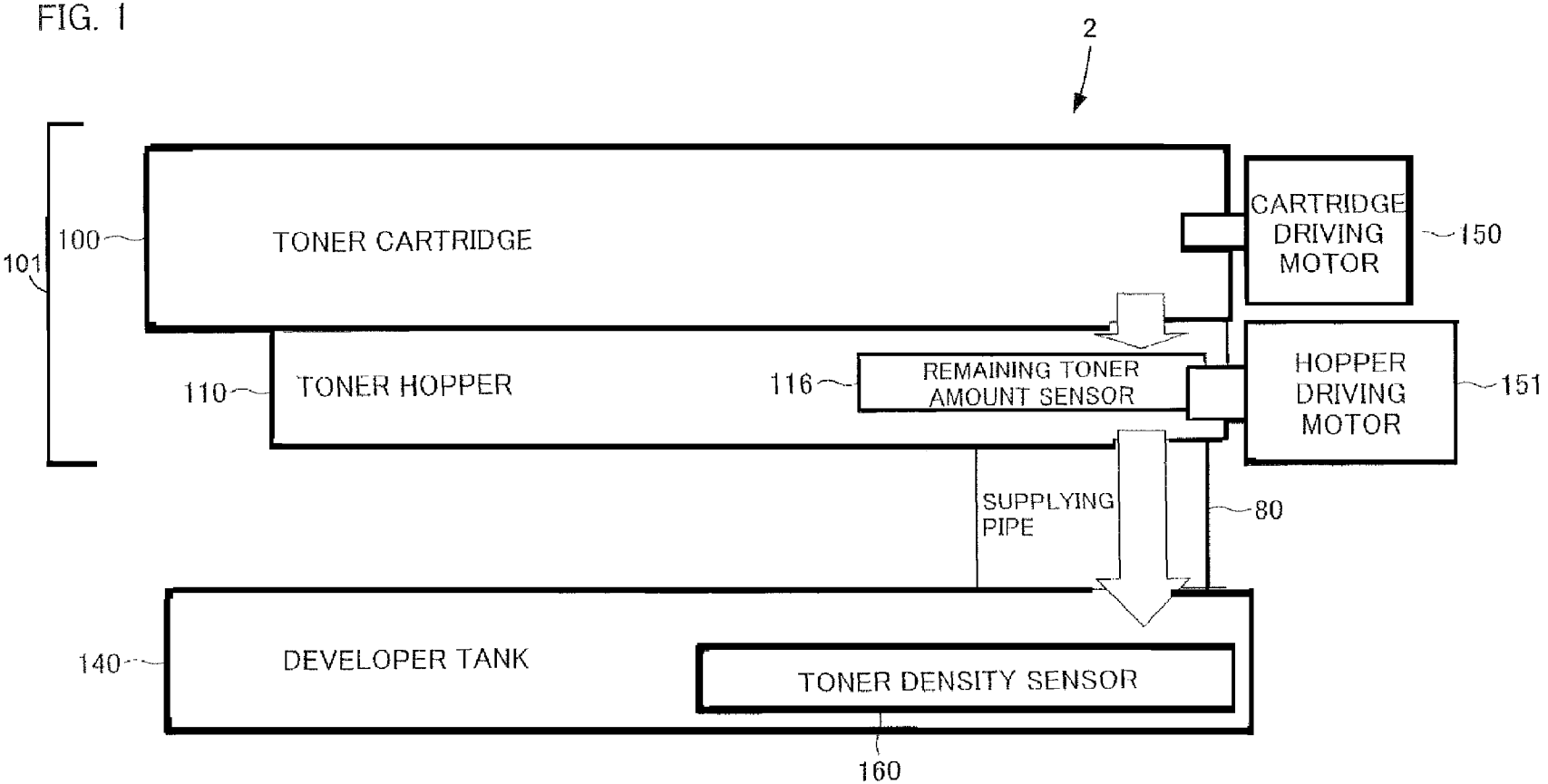
FIG. 1 is a pattern diagram showing a developing device including a toner supplying device according to an example embodiment.

FIG. 1 is a pattern diagram showing a developing device 2 including the toner supplying device 101. A toner density sensor 160 shown in FIG. 1 is provided in the developer tank 140 so as to detect the density of toner contained in the developer tank 140.

Figure 10:
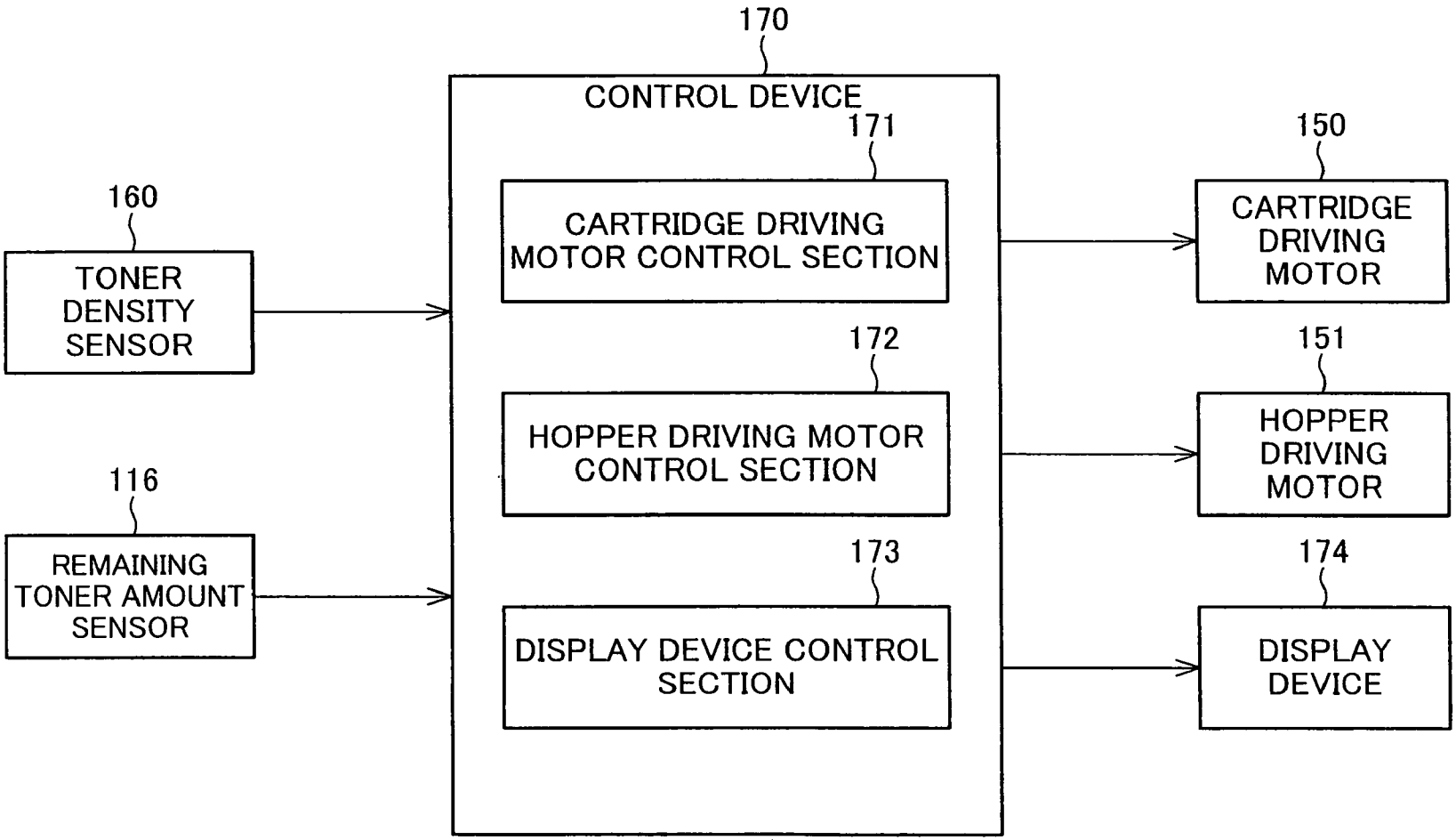
FIG. 10 is a block diagram showing an arrangement of a control device of the toner supplying device shown in FIG. 1.

The following explains a toner supply control operation of the toner supplying device 101 supplying toner to the developer tank 140. The toner supplying device 101 has a control device 170 shown in FIG. 10. The control device 170 controls, in accordance with signals detected by the toner density sensor 160 and by the remaining toner amount sensor 116, how the cartridge driving motor 150 and the hopper driving motor 151 are operated.

That is, the control device 170 carries out a first control operation as follows: In cases where it is determined, in accordance with a result of detection carried out by the remaining toner amount sensor 116, that the amount of toner remaining in the toner hopper 110 is insufficient, the cartridge driving motor 150 is rotated, so that the toner cartridge 100 supplies toner to the toner hopper 110. Further, the control device 170 carries out a second control operation as follows: In cases where it is determined, in accordance with a result of detection carried out by the toner density sensor 160, that the density of toner contained in the developer tank 140 is insufficient, the hopper driving motor 151 is rotated, so that the toner hopper 110 supplies toner to the developer tank 140. Further, during the second control operation, the control device 170 rotates the cartridge driving motor 150 in cases where the control device 170 has rotated the hopper driving motor 151. Specifically, in cases where the hopper driving motor 151 has been rotated for a first set time (predetermined time) or longer, the cartridge driving motor 150 is rotated for a second set time (predetermined time).

Thus, during the second control operation, the cartridge driving motor 150 is rotated in conjunction with the rotation of the hopper driving motor 151 regardless of a result of detection carried out by the remaining toner amount sensor 116, so that the toner hopper 110 is always kept substantially full of toner. Thus, even in cases where the toner hopper 110 is small and can contain only a small amount of toner, the developer tank 140 can be supplied with toner stably, i.e., uninterruptedly and continuously.

Particularly, in the present embodiment, the toner hopper 110 has a small capacity, and is arranged so as to supply toner to the developer tank 140 while transporting toner in the horizontal directions via the first and second toner transportation paths 111 and 112. In this case, the toner supplied to the first toner transportation path 111 via the toner inlet 114 is sequentially transported from the location of the toner inlet 114 to the toner outlet 115 via the first and second toner transportation paths 111 and 112 by the toner transporting screw 118. Therefore, when the supply of toner from the toner cartridge 100 to the toner hopper 110 is interrupted while the toner hopper 110 is transporting toner, the first and second toner transportation paths 111 and 112 are likely to have a region free of toner. When such a situation arises, the supply of toner from the toner hopper 110 to the developer tank 140 is temporarily interrupted, so that the supply of toner to the developer tank 140 becomes unstable. As a result, the density of toner contained in the developer tank 140 becomes unstable.

In order to prevent such a situation, it is preferable that each of the first and second toner transportation paths 111 and 112 of the toner hopper 110 be prevented from having a region free of toner, i.e., that the substantially whole area of each of the first and second toner transportation paths 111 and 112 be filled with a predetermined amount of toner or more. In light of this, in cases where the rotation of the hopper driving motor 151 causes toner to be transported via the first and second toner transportation paths 111 and 112, it is preferable that: the cartridge driving motor 150 be rotated regardless of a result of detection carried out by the remaining toner amount sensor 116, so that toner is supplied from the toner cartridge 100 so as to prevent a region free of toner (such a region being hereinafter referred to as "toner shortage region") from being generated in a part, which is directly below the toner inlet 114, of the first toner transportation path 111. Therefore, in this case, the cartridge driving motor 150 is rotated in conjunction with the rotation of the hopper driving motor 151. However, the cartridge driving motor 150 does not need to start to be rotated at the same time as the hopper driving motor 151 starts to be rotated. The cartridge driving motor 150 may start to be rotated later than a point of time at which the hopper driving motor 151 starts to be rotated, as long as the toner cartridge 100 can supply toner to the toner hopper 110 so that a toner shortage region is not generated.

Substantially a certain amount of toner is gradually discharged from the toner hopper 110 to the supplying pipe 80 in accordance with the rotation of the toner transporting screw 118. Therefore, even when the supplying pipe 80 has a narrow toner passageway, no toner clog is generated within the toner passageway.

In order to carry out the foregoing control operation, the control device 170 includes a cartridge driving motor control section 171, a hopper driving motor control section 172, and a display device control section. 173. The display device control section 173 supplies display data to a display device 174 for displaying various states of the toner supplying device 101 and of the developing device 2, and causes the display device 147 to display information concerning the various states. The display device 147 is provided, for example, in an operation panel of the printer A.

Figure 11:
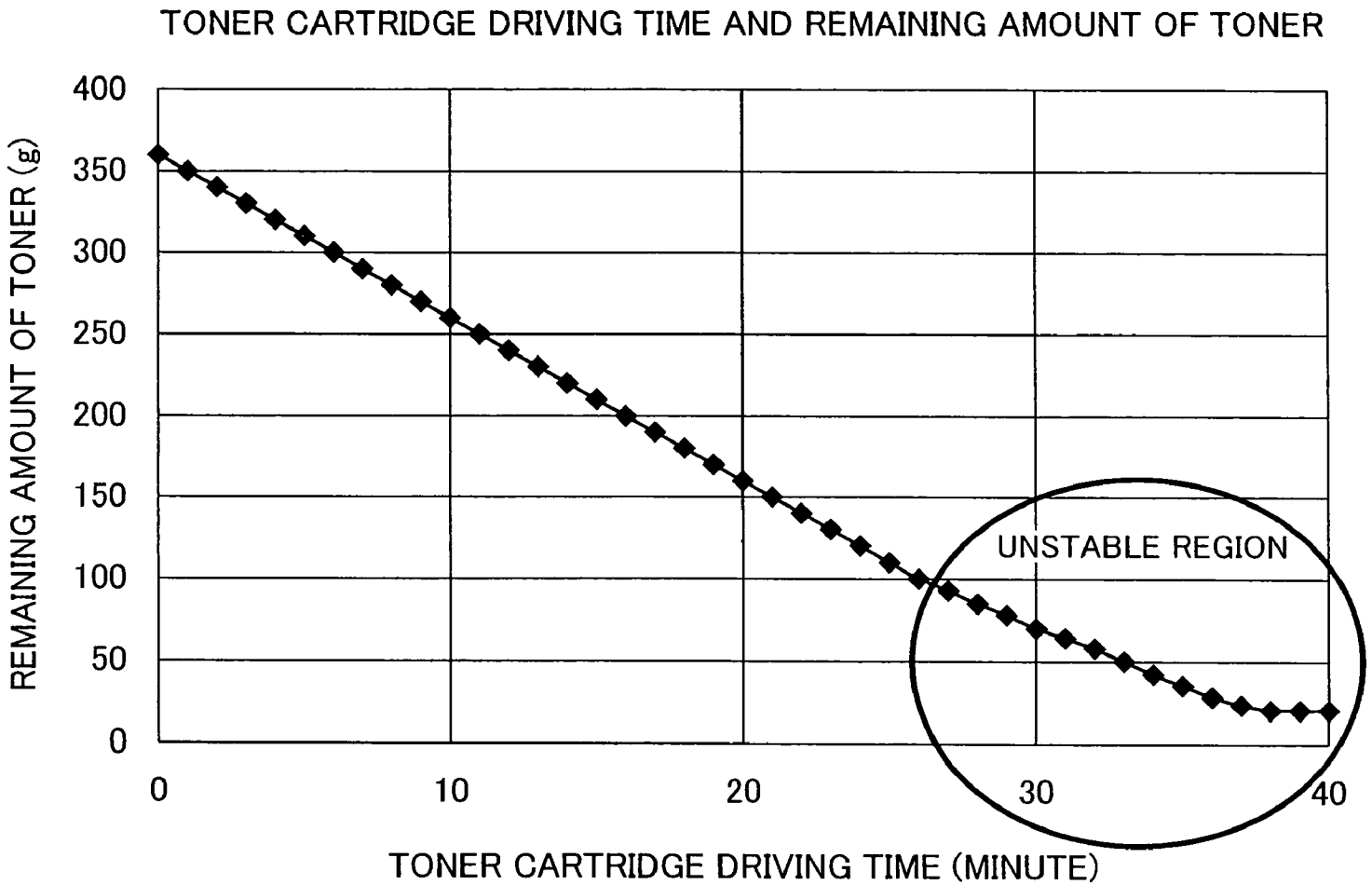
FIG. 11 is a graph showing a relationship between (i) the toner cartridge driving time during which a toner cartridge shown in FIG. 3 is driven, and (ii) the amount of toner remaining in the toner cartridge.

FIG. 11 shows a relationship between (i) the driving time (continuous driving time) of the toner cartridge 100 of the present embodiment, and (ii) the amount of toner remaining in the toner cartridge 100. The driving time of the toner cartridge 100 corresponds to a period of time during which an after-mentioned toner bottle of the toner cartridge 100 is rotated. As evidenced by FIG. 11, when the driving time exceeds 25 minutes, an unstable region appears where the remaining amount of toner (amount of toner supplied) does not change linearly.

In the toner hopper 100 of the present embodiment, the remaining toner amount sensor 116 is provided near the toner inlet 114. Therefore, also by carrying out, in accordance with a result of detection carried out by the remaining toner amount sensor 116, such a toner supply control operation that the toner cartridge 100 supplies toner to the toner hopper 110, it is possible to prevent the toner hopper 110 from having a toner shortage region.

The following explains examples of the toner supply control operation so carried out by the control device 170 as to prevent the toner hopper 110 from having a toner shortage region.

EXAMPLE 1

Figure 12:
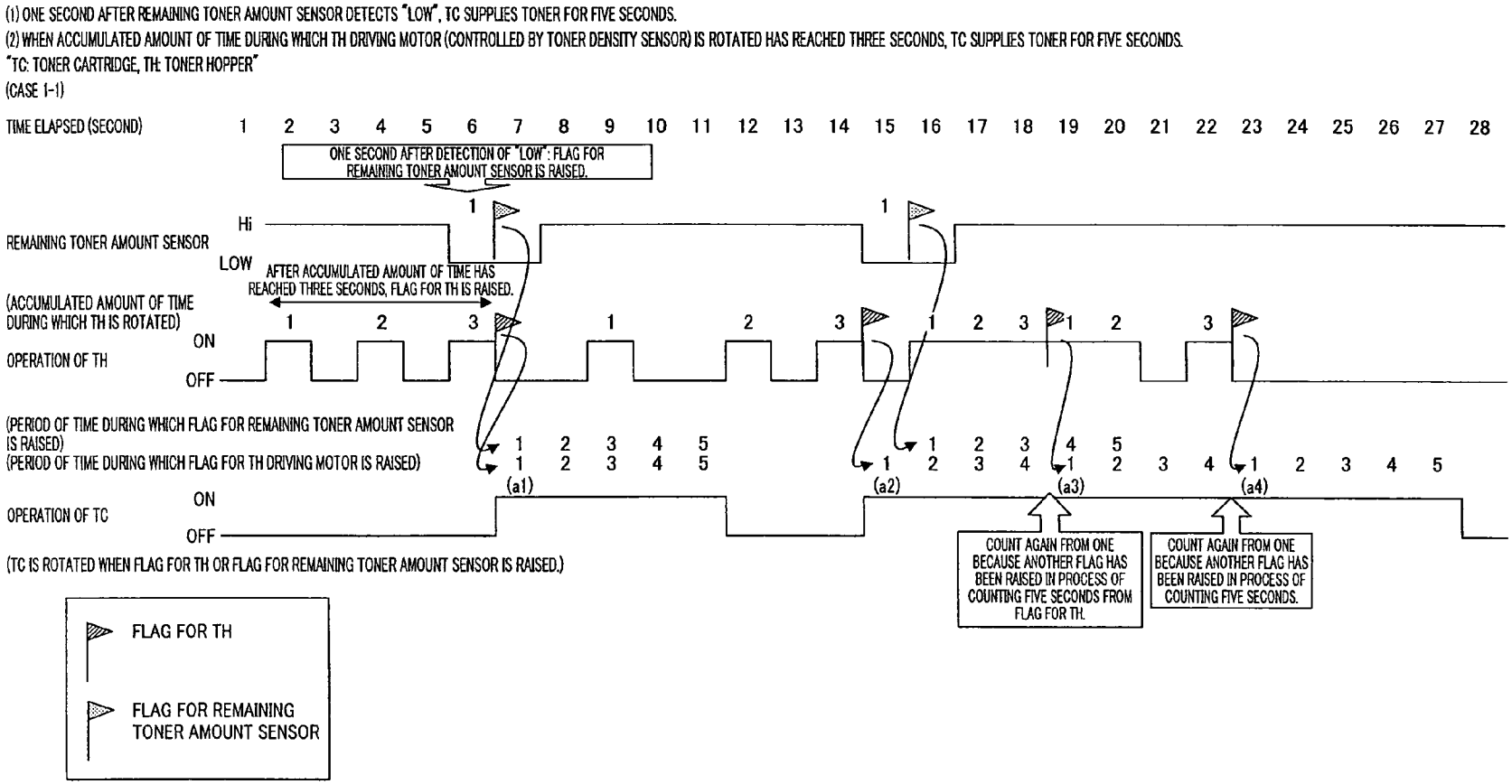
FIG. 12 is a timing chart showing an example of control operation carried out with respect the toner supplying device by the control device shown in FIG. 10.

FIG. 12 is a timing chart showing an example of the toner supply control operation carried out by the control device 170. In this example, the following two control operations are carried out:

(1) One second after the remaining toner amount sensor 116 indicates a detection result "Low" (toner supply required), an operation of supplying toner from the toner cartridge 100 is carried out for five seconds (the cartridge driving motor 150 is rotated for five seconds).

(2) When integrated time during which the hopper driving motor 151 is rotated has reached three seconds, an operation of supplying toner from the toner cartridge 100 is carried out for five seconds.

FIG. 12 shows an example (Case 1-1) in which the aforementioned control operations (1) and (2) are carried out.

In FIG. 12, the operation (a1) of the toner cartridge 100 is attributed to the control operation (1) or (2). The operation period during which the toner cartridge 100 is operated due to the control operation (1) corresponds to the operation period during which the toner cartridge 100 is operated due to the control operation (2). Therefore, the toner cartridge 100 is not operated in accordance with each of the control operations (1) and (2).

The operation (a2) of the toner cartridge 100 is started due to the control operation (2). In this example, the integrated time during which the toner hopper 110 is rotated has reached three seconds before the five-second-long operation (a2) of the toner cartridge 100 is finished, so that the next operation (a3) due to the control operation (2) is started. In this case, a calculation of an amount of time during which the toner cartridge 100 is operated is started at the same time as the operation (a3) is started. The same holds for the operation (a4). That is, the integrated time during which the toner hopper 110 is rotated has reached three seconds before the five-second-long operation (a3) of the toner cartridge 100 is finished, so that the operation (a4) due to the control operation (2) is started. After the toner cartridge 100 has carried out the five-second-long operation, the toner cartridge 100 finishes being operated.

Figure 13:
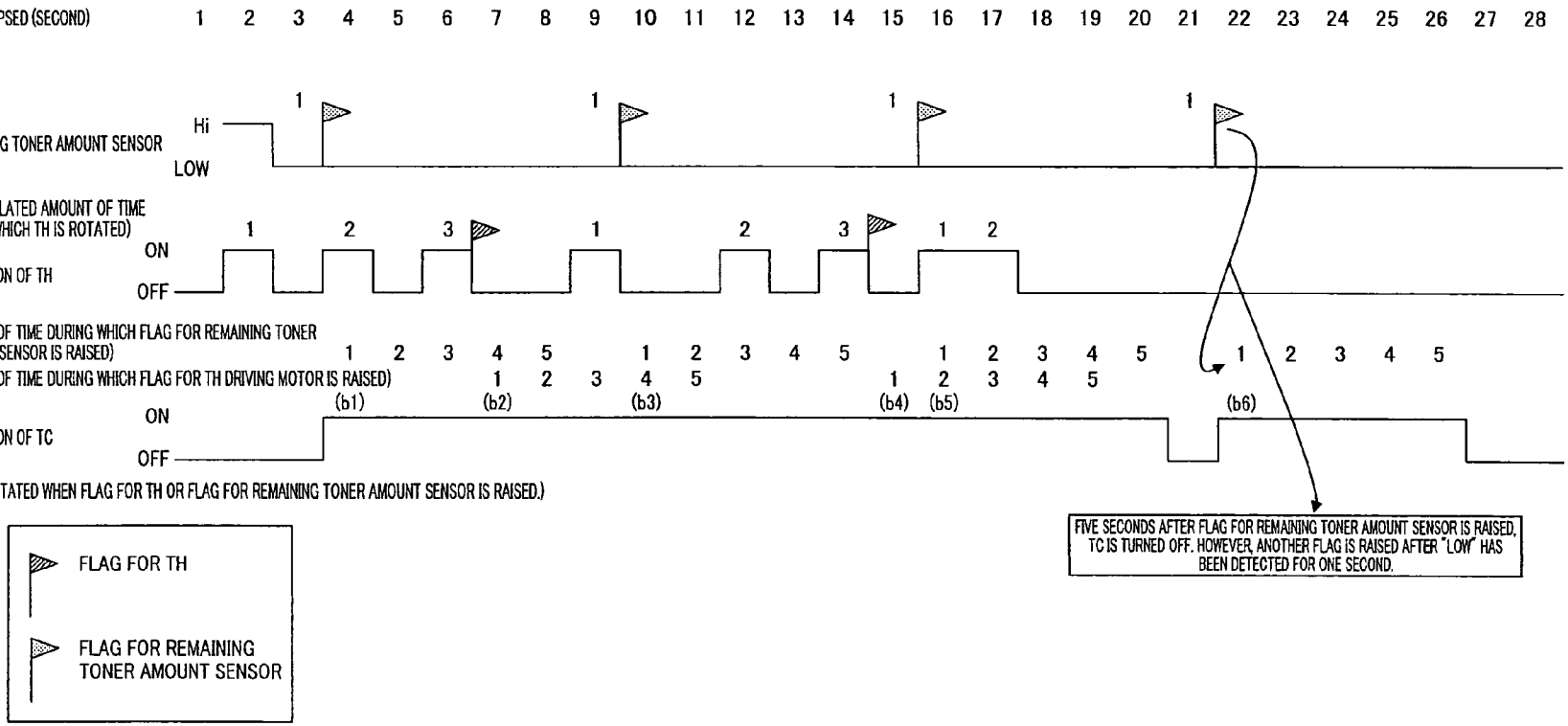
FIG. 13 is a timing chart showing a control operation carried out by the control device in cases where a remaining toner amount sensor always indicates "Low", in the example shown in FIG. 12.

FIG. 13 shows another example (Case 1-2) in which the aforementioned control operations (1) and (2) are carried out, and is a timing chart showing a toner supply control operation carried out in cases where the remaining toner amount sensor 116 always indicates a detection result "Low".

In FIG. 13, the operation (b1) of the toner cartridge 100 is started due to the control operation (1). Thereafter, the integrated time during which the toner hopper 110 is rotated has reached three seconds before the five-second-long operation (b1) of the toner cartridge 100 is finished, so that the next operation (b2) due to the control operation (2) is started. Furthermore, the next operation (b3) due to the control operation (1) is started before the five-second-long operation (b2) of the toner cartridge 100 is finished. After the operation (b3) is finished, the operation (b4) due to the control operation (2) is started without interruption. Before the operation (b4) is finished, the operation (b5) due to the control operation (1) is started. Thereafter, the five-second-long operation (b5) of the toner cartridge 100 is finished. Then, a result of detection carried out by the remaining toner amount sensor 116 is judged. Since the detection result is judged to be "Low", the operation (b6) due to the control operation (1) is carried out again.

Figure 14:
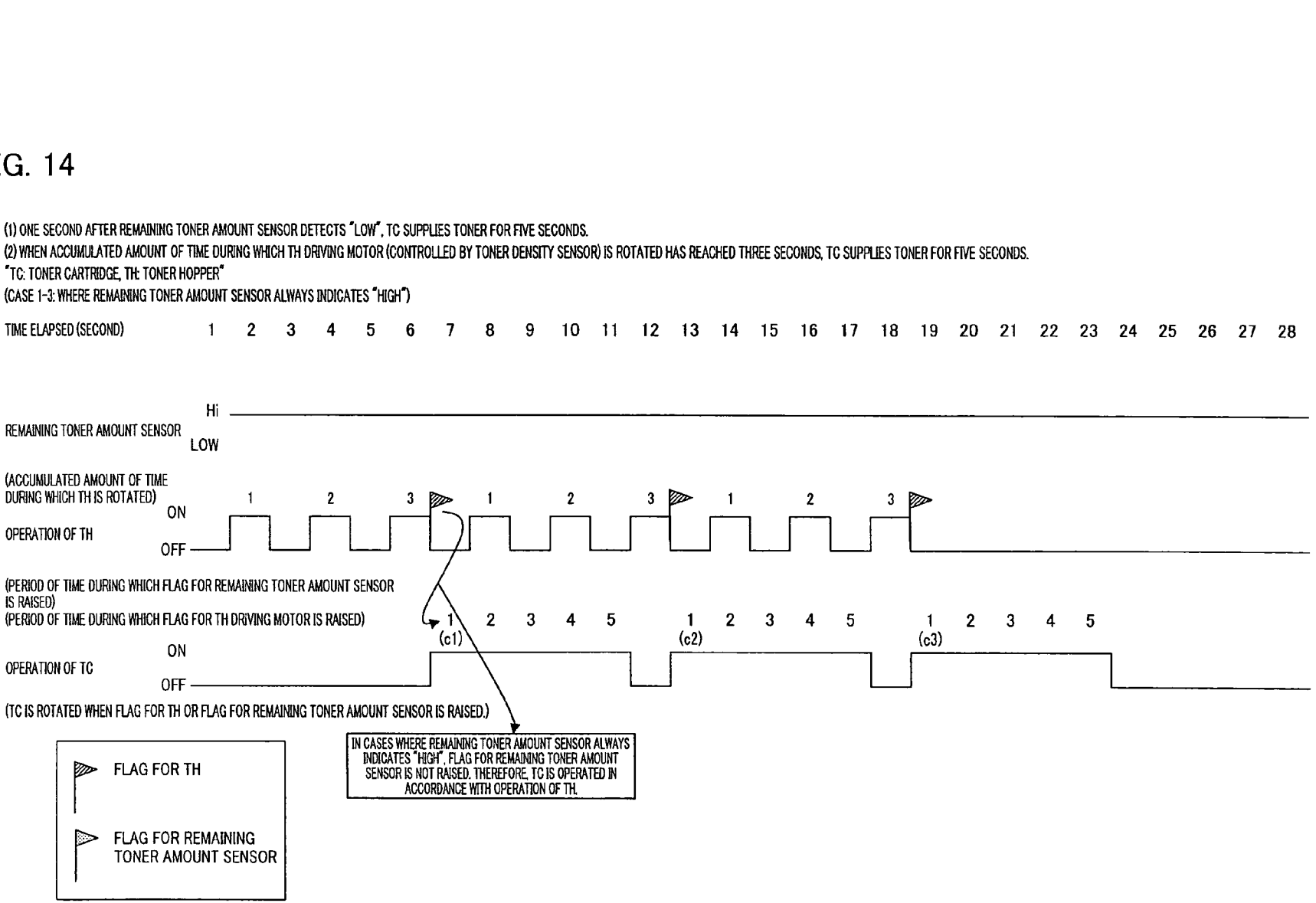
FIG. 14 is a timing chart showing a control operation carried out by the control device in cases where the remaining toner amount sensor always indicates "High", in the example shown in FIG. 12.

FIG. 14 shows another example (Case 1-3) in which the aforementioned control operations (1) and (2) are carried out, and is a timing chart showing a toner supply control operation carried out in cases where the remaining toner amount sensor 116 always indicates a detection result "High".

In FIG. 14, since the remaining toner amount sensor 116 always indicates a detection result "High", the toner cartridge 100 is not operated due to the control operation (1).

The operation (c1) of the toner cartridge 100 is started due to the control operation (2), so that the toner cartridge 100 supplies toner for five seconds. Thereafter, when the integrated time during which the hopper driving motor 151 has reached three seconds, the operation (c2) of the toner cartridge 100 is carried out due to the control operation (2). Thereafter, the operation (c3) of the toner cartridge 100 is similarly carried out due to the control operation (2).

EXAMPLE 2

Figure 15:
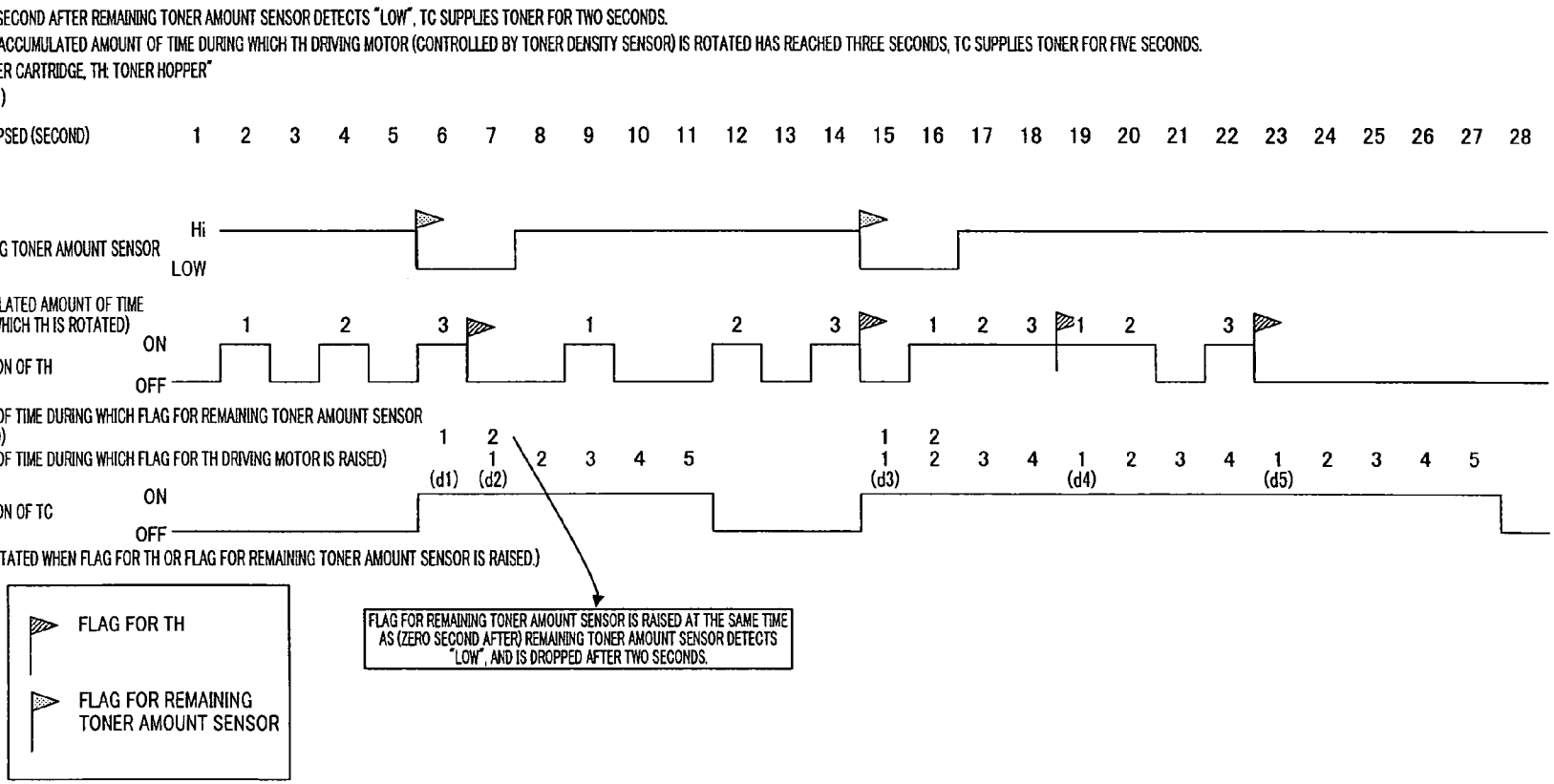
FIG. 15 is a timing chart showing another example of control operation carried out with respect to the toner supplying device by the control device shown in FIG. 10.

FIG. 15 is a timing chart showing another example of the toner supply control operation carried out by the control device 170. In this example, the following control operation (3) is carried out instead of the aforementioned control operation (1). Note that the control operation (2) is carried out in the same manner as in Example 1. That is, the following two operations are carried out:

(3) At the point of time when (zero second after) the remaining toner amount sensor 116 indicates a detection result "Low" (toner supply required), an operation of supplying toner from the toner cartridge 100 is carried out for five seconds (the cartridge driving motor 150 is rotated for two seconds).

(2) When integrated time during which the hopper driving motor 151 is rotated has reached three seconds, an operation of supplying toner from the toner cartridge 100 is carried out for five seconds.

FIG. 15 shows an example (Case 2-1) in which the aforementioned control operations (3) and (2) are carried out.

In FIG. 15, the operation (d1) of the toner cartridge 100 is started due to the control operation (3). In this example, the integrated time during which the toner hopper 110 is rotated has reached three seconds before the five-second-long operation (d1) of the toner cartridge 100 is finished, so that the next operation (d2) due to the control operation (2) is started.

The operation (d3) of the toner cartridge 100 is attributed to the control operation (2). However, the start of the operation (d3) is attributed to the control operation (2) or (3). In this example, the next operation (d4) due to the control operation (2) is started before the operation (d3) is finished. The operation (d5) is started in the same manner as the operation (d4) is started. Thereafter, after the toner cartridge 100 has carried out the five-second-long operation, the toner cartridge 100 finishes being operated.

Figure 16:
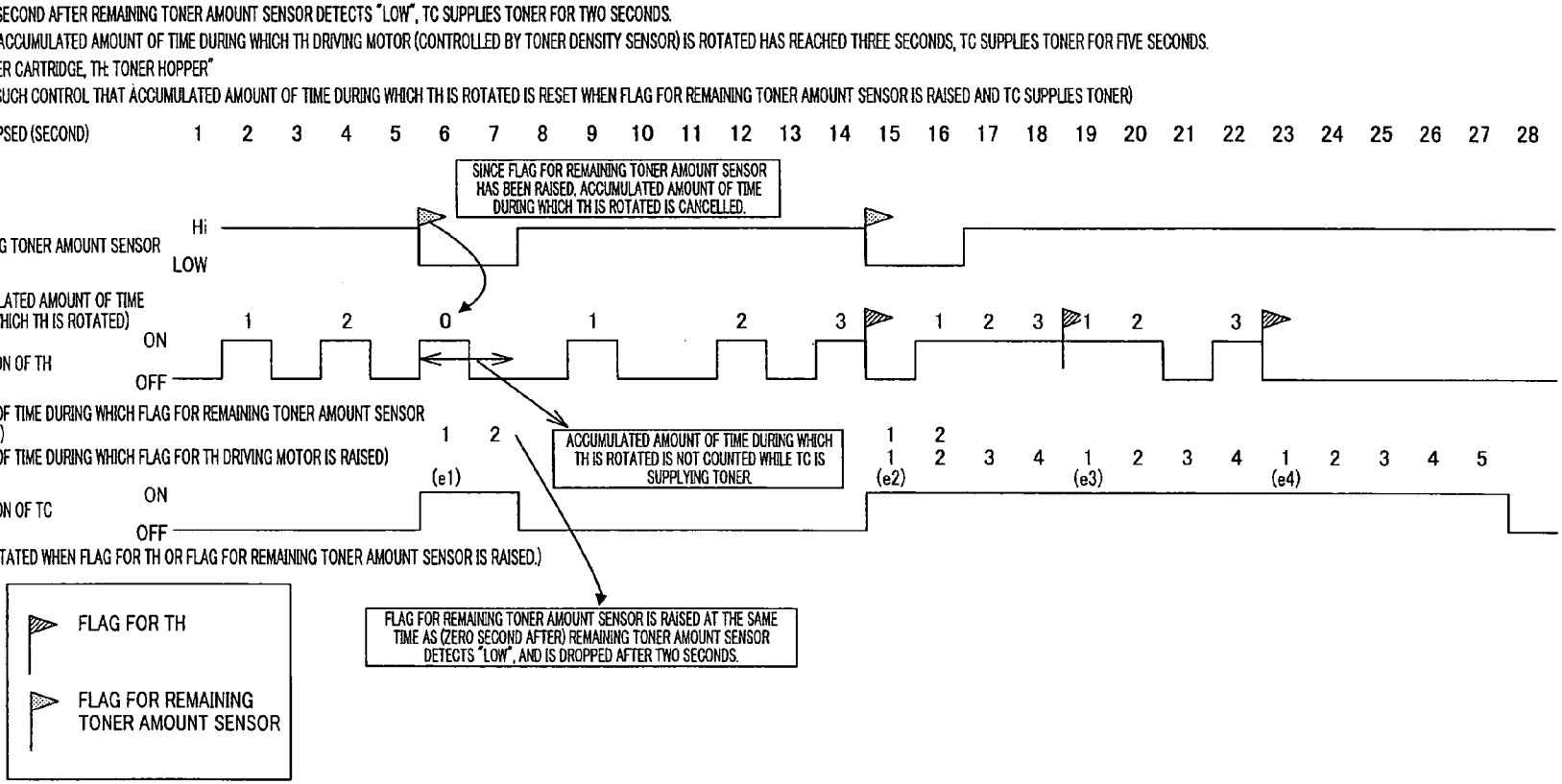
FIG. 16 is a timing chart showing another example of control operation carried out with respect to the toner supplying device by the control device shown in FIG. 10.

FIG. 16 is a timing chart showing another example (Case 3) in which the aforementioned control operations (3) and (2) are carried out. In this example, see a case where such an operation of supplying toner from the toner cartridge 100 to the toner hopper 110 is carried out for two seconds (control operation (3)) at the point of time when the remaining toner amount sensor 116 indicates a detection result "Low". In this case, a counting of the integrated rotation time of the toner hopper 110 for the purpose of the control operation (2) is not carried out while the toner cartridge 100 is being rotated (for two seconds). This prevents the toner cartridge 100 from supplying an excessive amount of toner to the toner hopper 110.

In FIG. 16, the operation (e1) of the toner cartridge 100 is started due to the control operation (3). In this case, a counting of the integrated rotation time of the toner hopper 110 for the purpose of the control operation (2) is not carried out. Note that the operations (e2), (e3) and (e4) of the toner cartridge 100 correspond to the operations (d3), (d4), and (d5) shown in FIG. 15, respectively.

According to the foregoing control operation, the hopper driving motor 151 is rotated in accordance with a toner supply request that is based on a result of detection carried out by the toner density sensor 160, and the rotation of the hopper driving motor 151 causes the cartridge driving motor 150 to be rotated. However, the hopper driving motor 151 and the cartridge driving motor 150 may be rotated in accordance with a toner supply request that is based on a result of detection carried out by the toner density sensor 160. In this case, for example, the cartridge driving motor 150 may be started at a later timing than the hopper driving motor 151 is started. With this, the toner cartridge 100 supplies toner to the toner hopper 110 so that the toner hopper 110 is prevented from having a toner shortage region.

Figure 17:
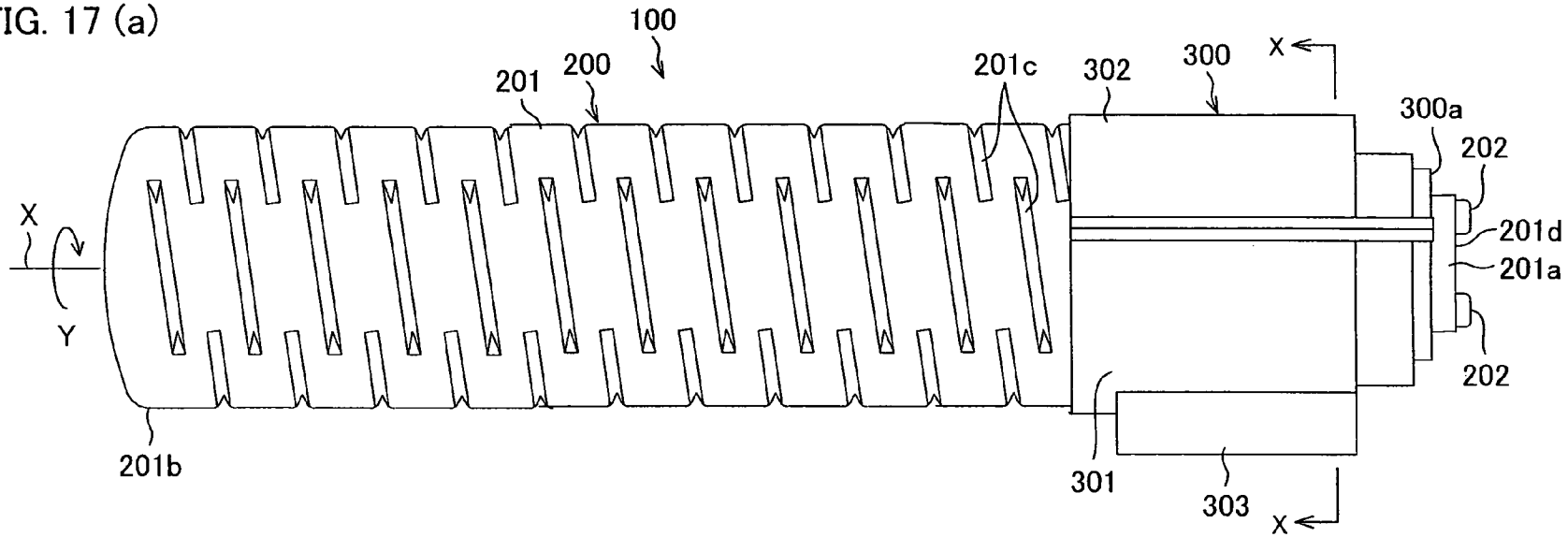
FIG. 17(*a*) is a side view of the toner cartridge shown in FIG. 3.
Figure 17:
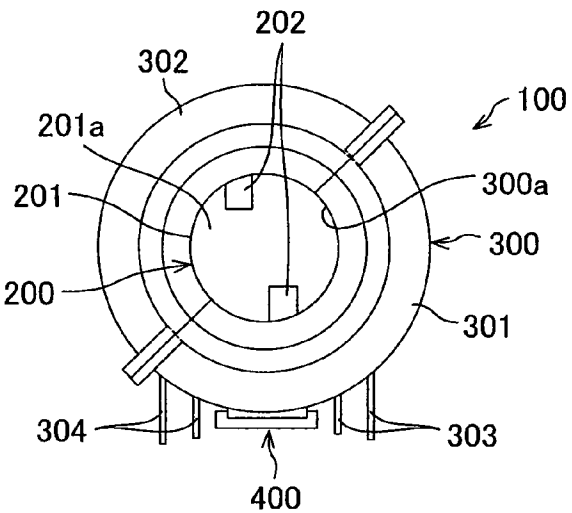

The following fully explains the toner cartridge 100. Note that the five toner cartridges 100 have the same structure. FIGS. 17(*a*) and 17(*b*) schematically show a structure of each of the toner cartridges 100. FIG. 17(*a*) is a side view of the toner cartridge 100, and FIG. 17(*b*) is a front view of the toner cartridge 100 as seen from an end face side from which toner is supplied.

As shown in FIG. 17(*a*), the toner cartridge 100 includes: a toner bottle 200, which contains toner serving as a developer; and a bottle supporting member 300, which rotatably supports an end portion of the toner bottle 200.

As shown in FIG. 17(*b*), the bottle supporting member 300 has a bottom surface (surface that faces down when the toner cartridge 100 is mounted in the printer A) on which a toner outlet is provided. Toner supplied from the toner bottle 200 is discharged to the toner hopper 110 via the toner outlet. Provided in the toner outlet is a shutter mechanism 400 for opening and closing the toner outlet.

(Toner Bottle 200)

As shown in FIG. 17(*a*), the toner bottle 200 includes a main body portion 201 having a substantially cylindrical shape. The main body portion 201 has a top end portion 201*a* supported by the bottle supporting member 300, and the top end portion 201*a* is provided with an opening via which toner is discharged. The main body portion 201 has a rear end portion 201*b* opposite to the top end portion 201*a*, and the rear end portion 201*b* is closed.

Further, the main body portion 201 has a surface on which a plurality of groove portions 201*c* are provided, and the groove portions 201*c* are depressed toward the rotation axis X. In an inner portion of the main body portion 201, portions corresponding to the groove portions 201*c* are protruding portions that protrude toward the rotation axis X.

A groove provided between the protruding portions serves as a guiding groove by which toner contained in the main body portion 201 is guided from the rear end portion 201*b* to the top end portion 201*a*. As shown in FIG. 17(*a*), each of the groove portions 201*c* has (i) a lower side which faces in the direction of gravitational force and which is tilted toward the top end portion 201*a* and (ii) an upper side which faces in an direction opposite to the direction of gravitational force and which is tilted toward the rear end portion 201*b*. Thus, when the toner bottle 200 is rotated on the rotation axis X in the direction Y, the toner contained in the toner bottle 200 is transported from the rear end portion 201*b* of the main body portion 201 to the top end portion 201*a* of the main body portion 201.

Figure 18:
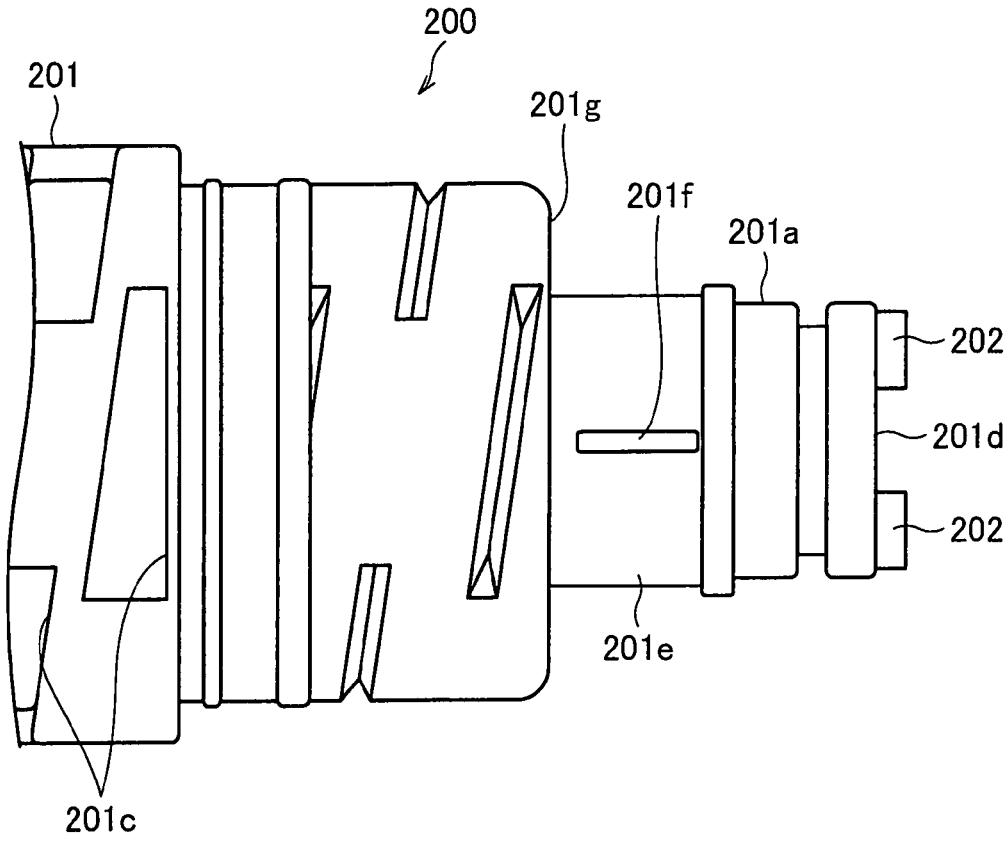
FIG. 18 is a side view of a top end portion of a toner bottle, shown in FIG. 17(*a*), which is provided in the toner cartridge.

As shown in FIG. 18, the top end portion 201*a* has a cylindrical shape having a diameter smaller than the diameter of a central portion of the main body portion 201. The top end portion 201*a* has a top end surface 201*d* on which outwardly protruding ribs 202 are provided. The ribs 202 engage with the cartridge driving motor 150 when the toner cartridge 100 is mounted in the printer A.

Figure 19:
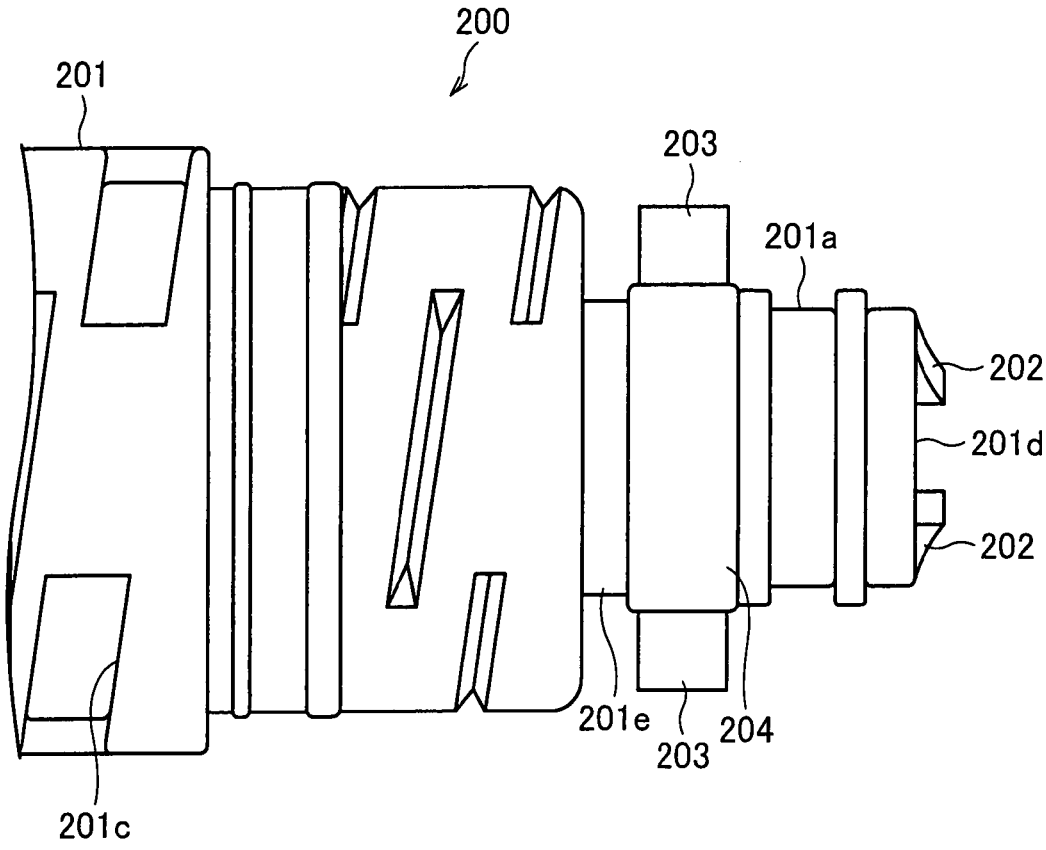
FIG. 19 is a side view illustrating that a scraper is mounted in the toner bottle's top end portion shown in FIG. 18.

Further, as shown in FIG. 19, the top end portion 201*a* has a circumferential surface 201*e* on which plate scrapers 203 are provided, and each of the scrapers 203 is made of elastic resin such as rubber. The scraper 203 is provided on a surface of a ring-shaped fixing member 204 made of stretchable material (elastic resin such as rubber).

Figure 20:
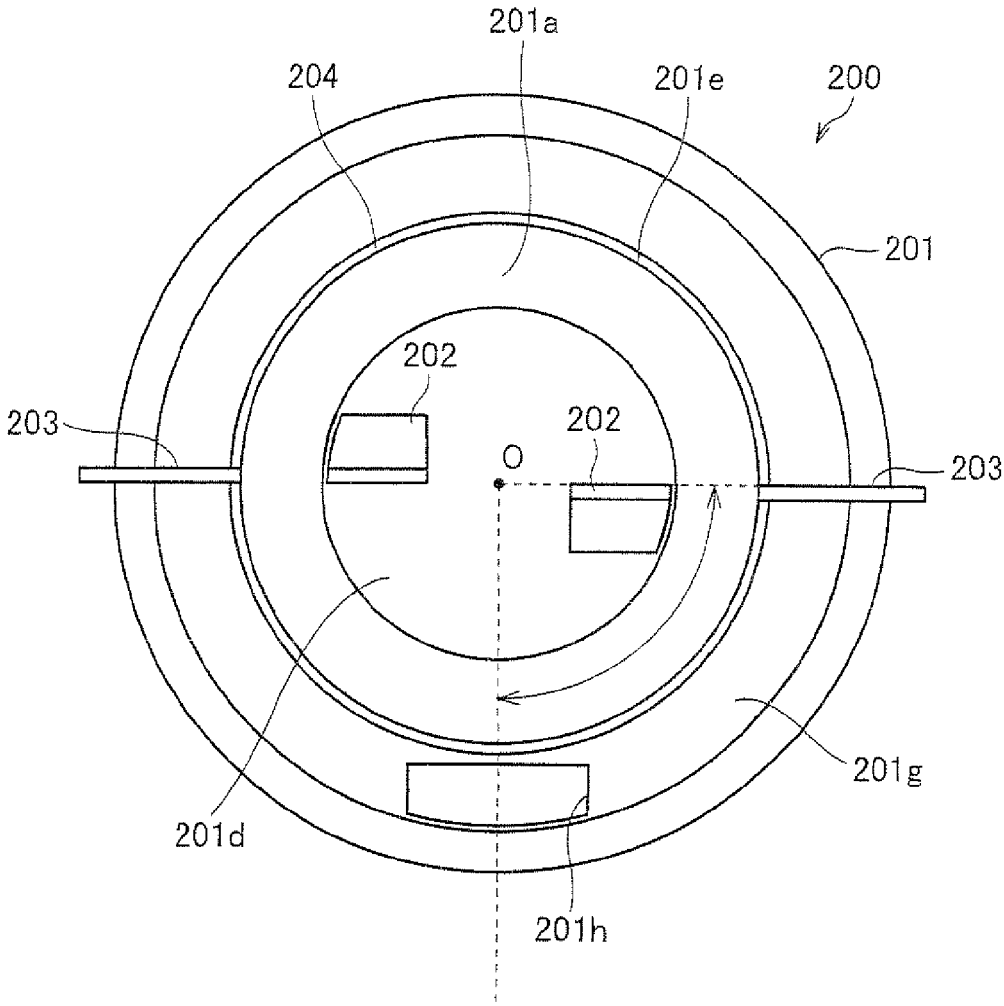
FIG. 20 is a front view of the toner bottle shown in FIG. 19.

As shown in FIG. 20, when the fixing member 204 is mounted on the top end portion 201*a*, the two scrapers 203 form a substantially straight line extending through the center O of the top end portion 201*a*.

Further, as shown in FIG. 20, the main body portion 201 has an end face 201*g* uneven with the top end portion 201*a*. On the end face 201*g*, as shown in FIG. 20, a bottle-side toner outlet 201*h* is provided via which the toner contained in the main body portion 201 is discharged.

The toner discharged via the bottle-side toner outlet 201*h* is stored in the bottle supporting member 300 provided so as to cover the top end portion 201*a*. The bottle supporting member 300 is provided with a supporter-side toner outlet via which the toner thus stored is discharged.

(Bottle Supporting Member 300)

As shown in FIGS. 17(*a*) and 17(*b*), the bottle supporting member 300 has a substantially cylindrical shape, and includes first and second housings 301 and 302 joined so as to cover the top end portion 201*a* of the main body portion 201. The bottle supporting member 300 is provided with a first opening 300*a* so that the ribs 202 provided on the top end surface 201*d* of the top end portion 201*a* are at least exposed.

Provided on a surface of the first housing 301 are first and second fixing members 303 and 304 for fixing the toner cartridge 100 mounted in the printer A shown in FIG. 2. As shown in FIG. 17(*b*), the shutter mechanism 400 is provided between the first fixing member 303 and the second fixing member 304. The shutter mechanism 400 carries out such a control operation that the toner supplied from the toner cartridge 100 is discharged outwardly.

Figure 21:
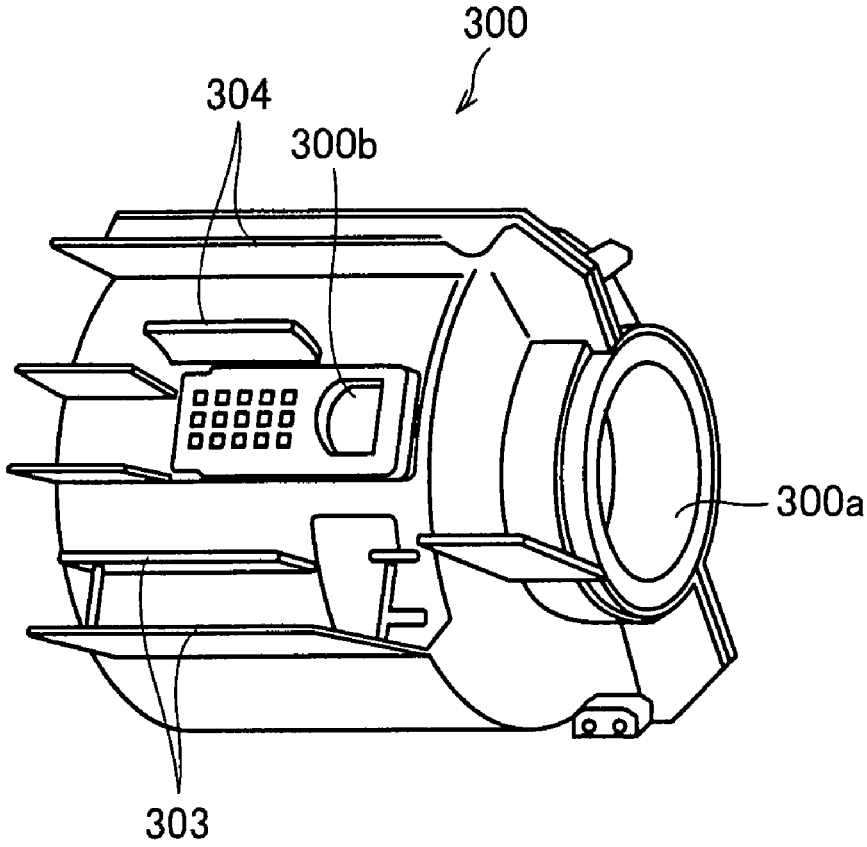
FIG. 21 is a perspective view of a lower surface of a bottle supporting member shown in FIGS. 17(*a*) and 17(*b*).

As shown in FIG. 21, the toner supporting member 300 has a supporter-side toner outlet 300*b* provided on a bottom surface side of the first housing 301, i.e., between the first fixing member 303 and the second fixing member 304. The supporter-side toner outlet 300*b* is opened and closed by the shutter mechanism 400.

Figure 22:
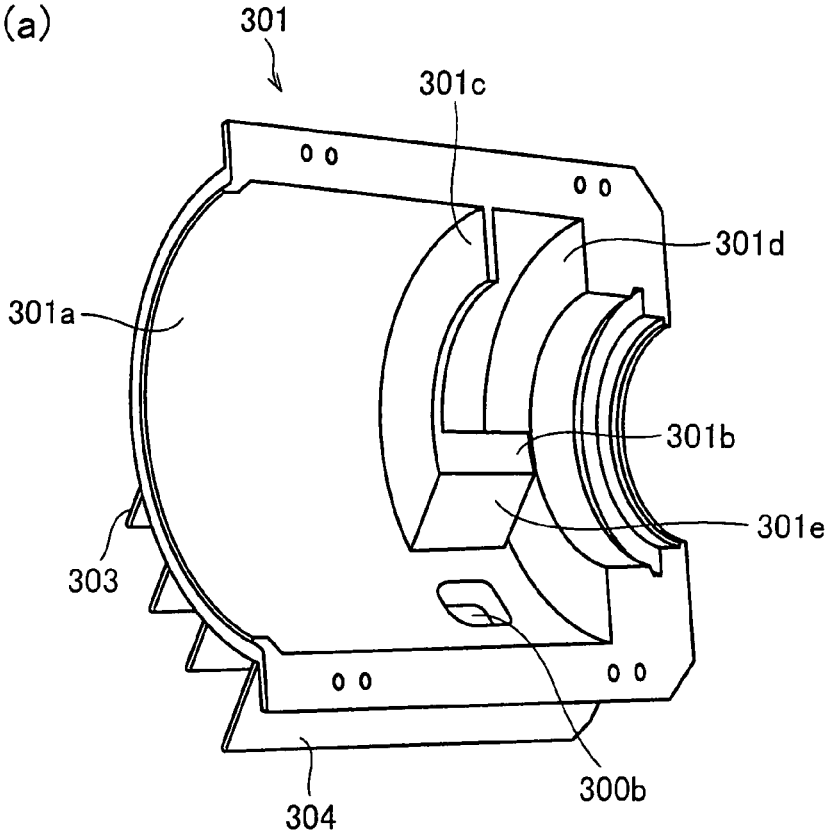
FIG. 22(*a*) is a perspective view of a first housing constituting the bottle supporting member shown in FIG. 21.
Figure 22:
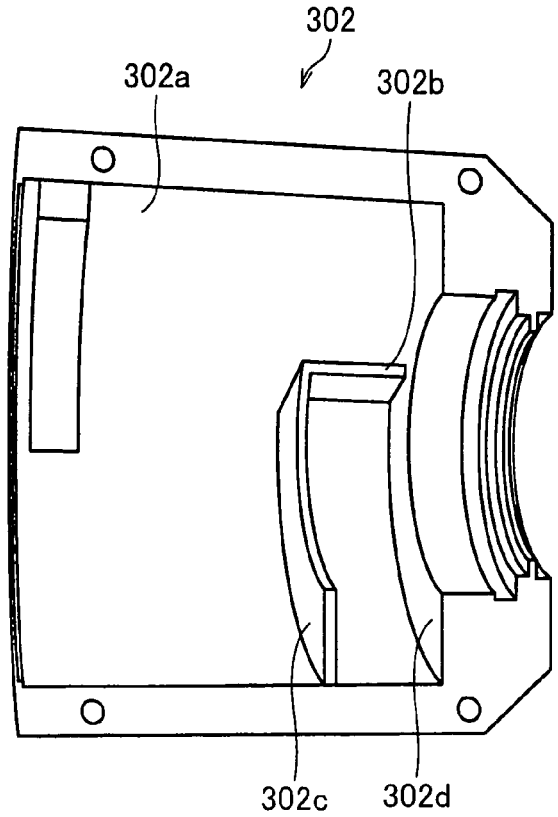

As shown in FIG. 22(*a*), the first housing 301 has an inner circumferential surface 301*a*. Provided near the aforementioned supporter-side toner outlet 300*b* on the inner circumferential surface 301*a* are (i) a first dam portion 301*b* for banking up toner and (ii) a wall portion 301*c* extending from the first dam portion 301*b* in a direction opposite to the supporter-side toner outlet 300*b*. The wall portion 301*c* is provided so as to be separated from a contact surface 301*d* by a predetermined distance. The contact surface 301*d* is an end surface of an inner portion of the first housing 301. The distance is set to be slightly wider than the width of each of the scrapers 203.

As shown in FIG. 22(*b*), as with the first housing 301 shown in FIG. 22(*a*), the second housing 302 has an inner circumferential surface 302*a*. Provided on the inner circumferential surface 302*a* are (i) a second dam portion 302*b* for banking up toner and (ii) a wall portion 302*c* extending from the second dam portion 302*b*. The wall portion 302*c* is provided so as to be separated from a contact surface 302*d* by a predetermined distance. The contact surface 302*d* is an end surface of an inner portion of the second housing 302. The distance is set to be slightly wider than the width of each of the scrapers 203.

Figure 23:
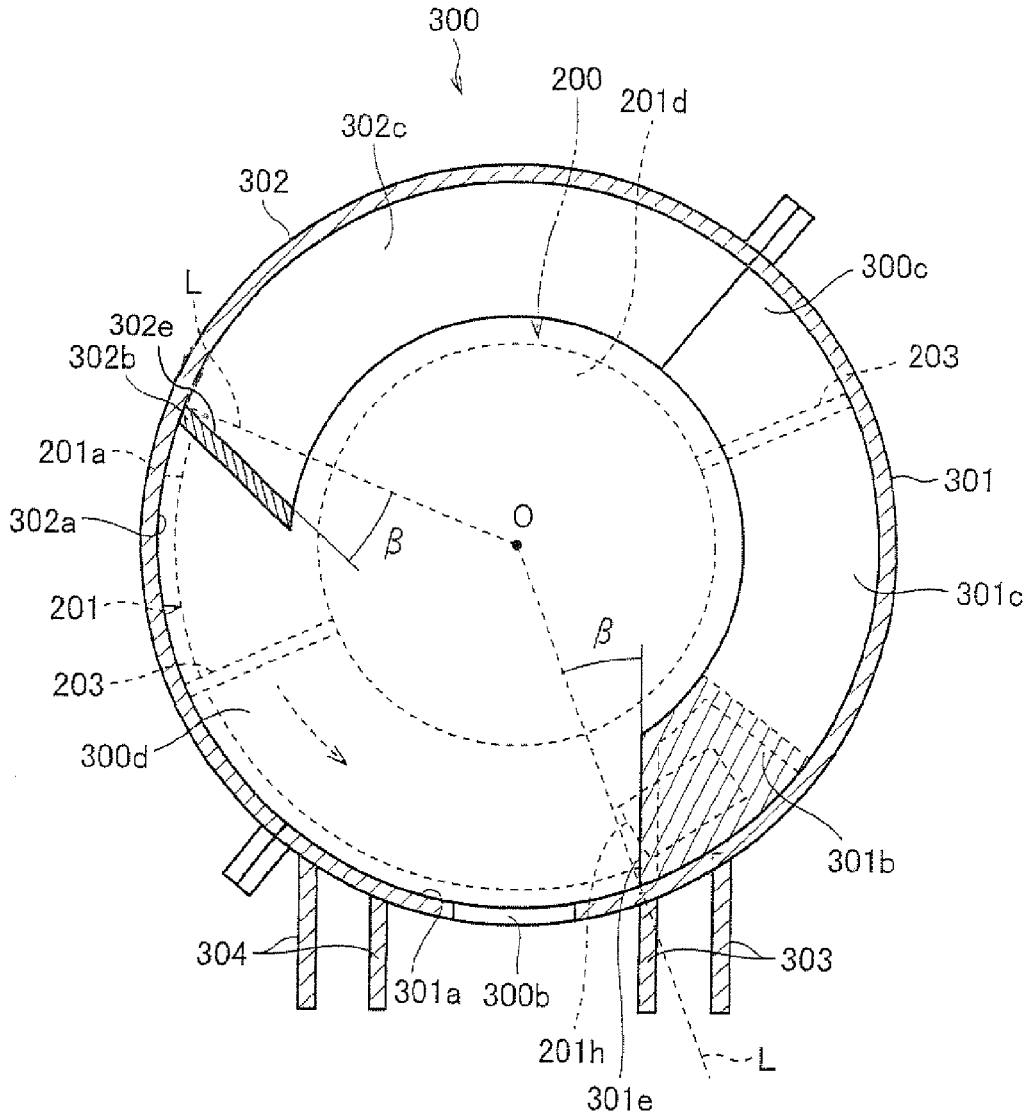
FIG. 23 is an explanatory diagram showing a relationship between (i) a toner discharging chamber of the toner supporting member shown in FIG. 21 and (ii) a location where the scraper of the toner bottle is provided.

The bottle supporting member 300 shown in FIG. 21 is obtained by combining the first housing 301 with the second housing 302. As shown in FIG. 23, when the first housing 301 and the second housing 302 are joined, a first space is formed which is surrounded by the first dam portion 301*b* of the first housing 301, the second dam portion 302*b* of the second housing 302, the wall portion 301*c*, and the wall portion 302*c*. In the present embodiment, the first space is referred to as a toner discharge regulating chamber 300*c* for regulating discharge of toner. On the other hand, apart from the first space, another space (second space) is formed between the first dam portion 301*b* and the second dam portion 302*b*. The second space is referred to as a toner discharging chamber 300*d* for temporarily storing toner supplied from the toner bottle 200 and then discharging the toner.

The toner discharge regulating chamber 300*c* is not a space into which toner is actually discharged, but functions as a space through which the scraper 203 having passed over the first dam portion 301*b* is allowed to pass. In the toner discharge regulating chamber 300*c*, there exists a small amount of toner having passed over the first dam portion 301*b* together with the scraper 203. The toner is scraped out through the second dam portion 302*b* by a rotational movement of the scraper 203.

On the other hand, the toner discharging chamber 300*d* functions as a space in which toner discharged via the bottle-side toner outlet 201*h* of the toner bottle 200 is temporarily stored.

As shown in FIG. 23, the first dam portion 301*b* has a contact surface 301*e* that makes contact with the scraper 203. The contact surface 301*e* is tilted toward a rotation direction of the scraper 203 (i.e., toward the direction of the arrow of FIG. 23) so that the scraper 203 can successfully pass over the first dam portion 301*b*. That is, the contact surface 301*e* is tilted so as to be displaced, in the rotation direction of the scraper 203, from a normal line L extending from the center of rotation O of the toner bottle 200.

In other words, the first dam portion 301*b* is provided on an upstream side of a direction in which toner is transported by the scraper 203, and has the contact surface 301*e* which makes contact with the scraper 203 and which is tilted by a predetermined angle β from the normal line L extending from the center of rotation O. In this way, the toner discharging chamber 300*d* becomes separate. The angle β is appropriately set depending on the material of the scraper 203, the length of the scraper 203, and other factors.

Further, the first dam portion 301*b* is provided in a location that is slightly displaced from the toner outlet 300*b* in the rotation direction of the scraper 203. With this, toner is easily accumulated in the toner discharging chamber 300*d*. By thus making it easy for toner to be accumulated in the toner discharging chamber 300*d*, it becomes possible to stabilize the amount of toner to be supplied via the toner outlet 300*b*. That is, this makes it possible to stably supply toner.

Furthermore, the length of each of the longer sides of the scraper 203 is set to be slightly longer than the distance between the center of rotation of the toner bottle 200 and the inner circumferential surface of the bottle supporting member 300, i.e., the inside diameter of the bottle supporting member 300. With this, toner stored in the toner discharging chamber 300*d* is efficiently scraped out.

Further, as with the first dam portion 301*b*, the second dam portion 302*b* has a contact surface 302*e* (i.e., surface facing toward the toner discharge regulating chamber 300*c*) that makes contact with the scraper 203. The contact surface 302*e* is tilted by a predetermined angle β from the normal line L extending from the center of rotation O. In this way, the toner discharging chamber 300*d* becomes separate. The angle β is appropriately set depending on the material of the scraper 203, the length of the scraper 203, and other factors.

(Explanation of a Sealing Mechanism)

In the toner cartridge 100 of the foregoing arrangement, the toner bottle 200 is rotatably supported by the bottle supporting member 300, so that there is a small gap between the toner bottle 200 and the bottle supporting member 300. For this reason, unless the gap is appropriately sealed, toner leaks somewhere other than the toner outlet 300*b* of the bottle supporting member 300.

Figure 24:
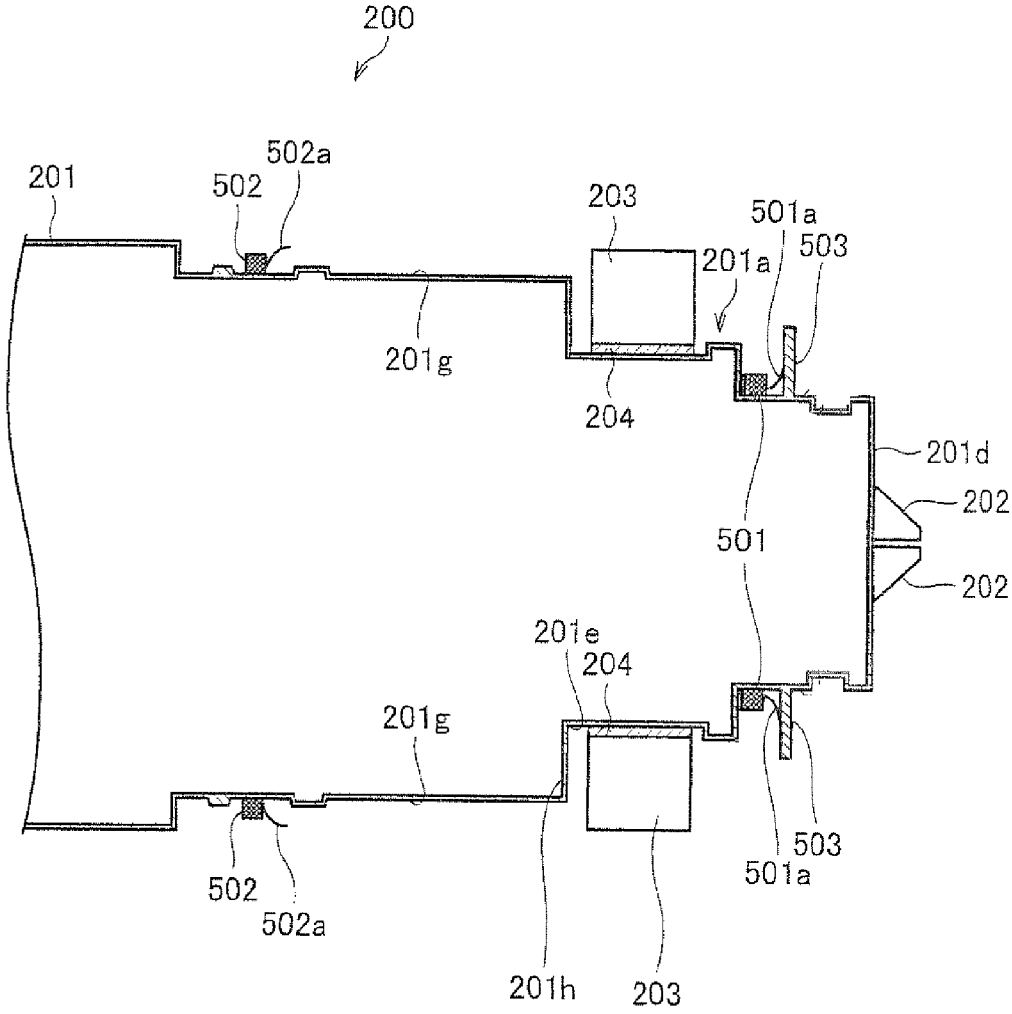
FIG. 24 is a schematic longitudinal sectional view of the toner bottle's top end portion shown in FIG. 19.

Therefore, in the present embodiment, as shown in FIG. 24, the top end portion 201*a* of the main body portion 201 of the toner bottle 200 is provided with two V-shaped rings 501 and 502 each serving as a seal.

The V-shaped ring 501 is mounted on a circumferential surface 201*f* of the top end portion 201*a*, and the circumferential surface 201*f* (FIG. 18) is closer to the ribs 202 than is the location in which the scraper 203 is mounted. The V-shaped ring 502 is mounted on the end face 201*g* of the top end portion 201*a*, and the end face 201*g* is farther from the ribs 202 than is the location in which the scraper 203 is mounted.

In a location farther from the main body portion 201 than is the location in which the V-shaped ring 501 is mounted, a slip ring 503 is mounted. The slip ring 503 ensures the clearance of the gap existing between the toner bottle 200 and the toner supporting member 300, and is a plate circular member for allowing the toner bottle 200 to be smoothly rotated.

The V-shaped rings 501 and 502 are mounted on the main body portion 201 so that (i) a sealing piece 501*a* of the V-shaped ring 501 is pressed against the slip ring 503 and (ii) a sealing piece 502*a* of the V-shaped ring 502 is pressed against an inner circumferential surface (described later) of the bottle supporting member 300. This allows each of the two V-shaped rings 501 and 502 to function as a seal.

The slip ring 503 rotatably engages with the circumferential surface 201*f* of the top end portion 201*a* of the main body portion 201, and is fixed by the inner circumferential surface of the bottle supporting member 300 when the bottle supporting member 300 is attached to the toner bottle 200.

Thus, the slip ring 503 is fixed by the bottle supporting member 300, and the main body portion 201 of the toner bottle 200 is rotated on an inner circumferential surface of the slip ring 503.

Figure 25:
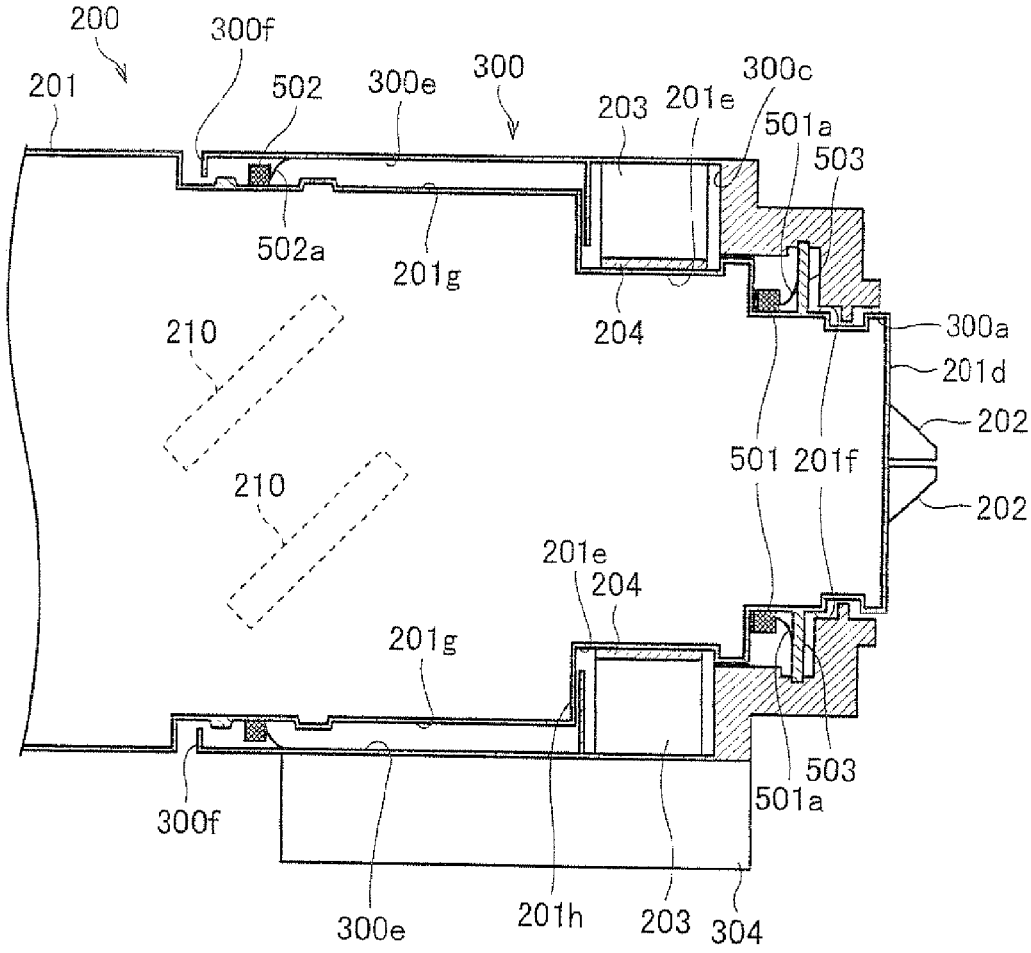
FIG. 25 is a schematic longitudinal sectional view illustrating that the bottle supporting member is attached to the toner bottle's top end portion shown in FIG. 19.

As shown in FIG. 25, the V-shaped ring 502 is mounted on the top end portion 201*a* so that when the top end portion 201*a* of the main body portion 201 of the toner bottle 200 is supported by the bottle supporting member 300, the sealing piece 502*a* is pressed against the inner circumferential surface 300*e* of the supporting member 300. This makes it possible to prevent toner from leaking from a rear end portion 300*f* of the bottle supporting member 300.

Further, as shown in FIG. 25, plate ribs 210 are provided on a circumferential surface of the top end portion 201*a* of the main body portion 201 of the toner bottle 200. The plate ribs 210 are made, for example, of elastic resin. The plate ribs 210 extend in parallel with each other in an oblique direction.

(Explanation of the Shutter Mechanism)

Figure 26:
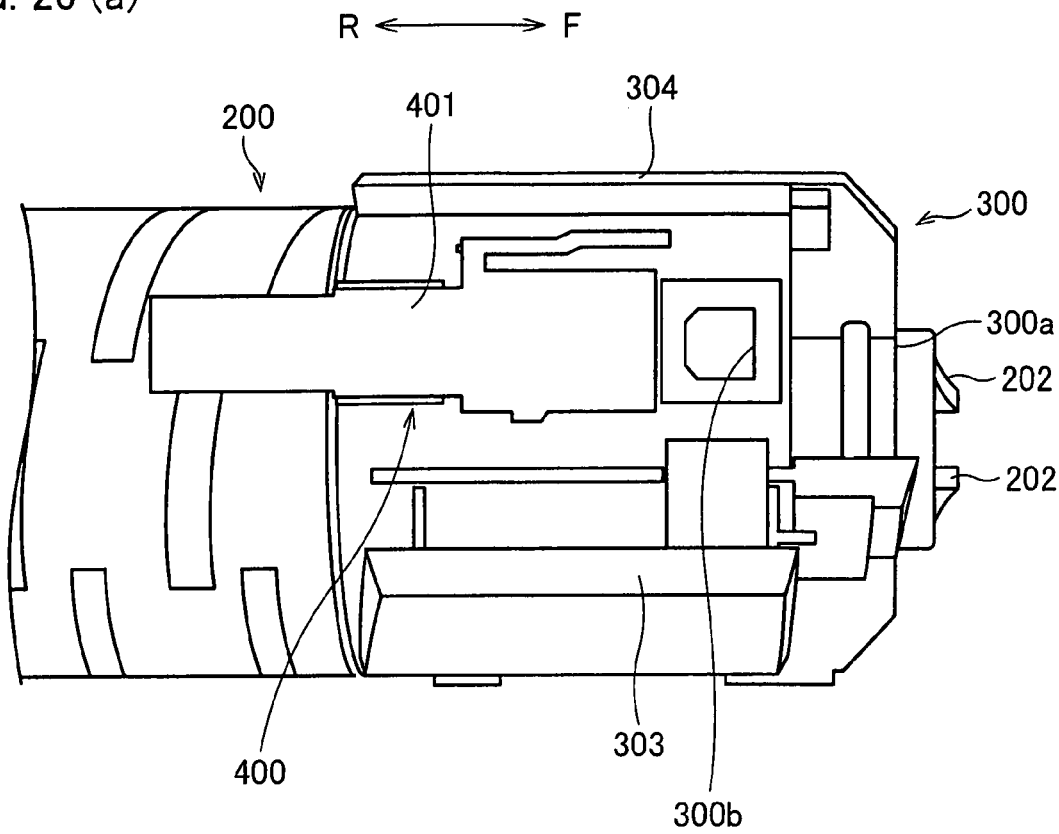
FIG. 26(*a*) is an explanatory diagram showing a state in which a shutter member is open in the toner cartridge shown in FIGS. 17(*a*) and 17(*b*).
Figure 26:
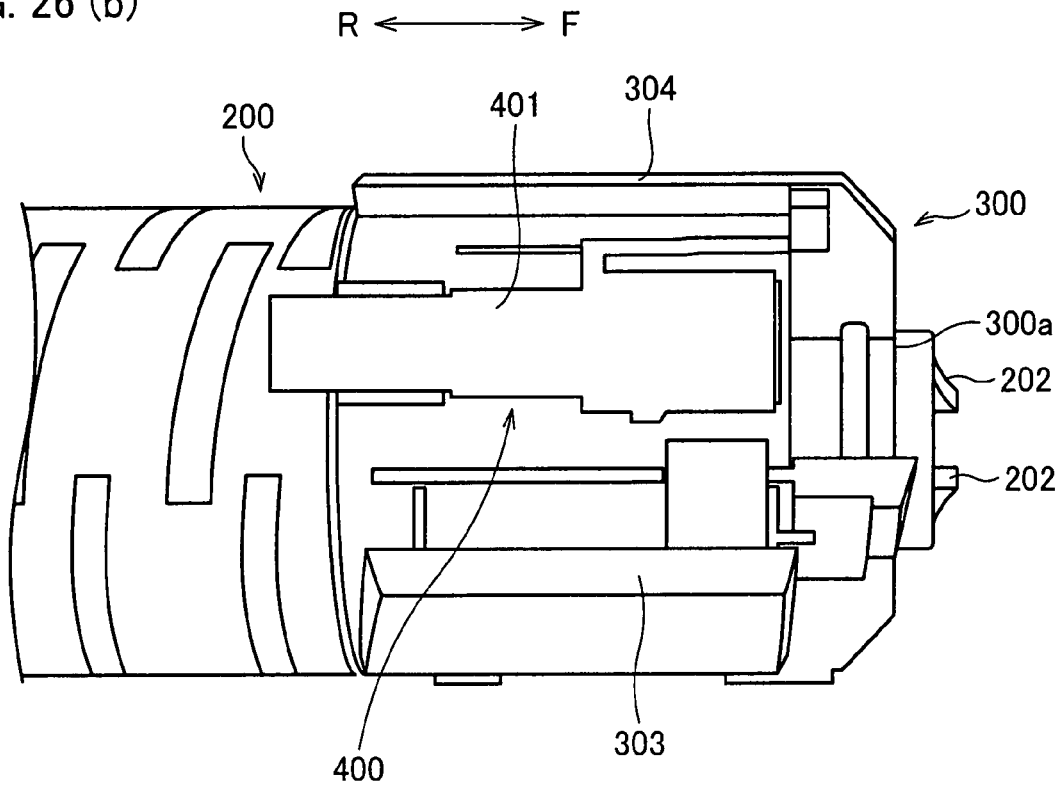

As shown in FIGS. 26(*a*) and 26(*b*), the shutter mechanism 400 includes a shutter member 401 capable of being slid in the direction of the arrow R and in the direction of the arrow F on the bottom surface of the bottle-supporting member 300. In FIGS. 26(*a*) and 26(*b*), the side toward which the ribs 202 of the toner bottle 200 protrudes from the opening 300*a* of the top end portion of the bottle supporting member 300 is referred to as "front (F) side", the side opposite to the F side is referred to as "rear (R) side".

FIG. 26(*a*) shows such a state that the toner outlet 300*b* of the bottle supporting member 300 is opened by sliding the shutter member 401 of the shutter mechanism 400 in the direction of the arrow R.

FIG. 26(*b*) shows such a state that the toner outlet 300*b* of the bottle supporting member 300 is closed by sliding the shutter member 401 of the shutter mechanism 400 in the direction of the arrow F.

The technology described herein makes it possible to stably supply a developer at a high speed, and therefore can be applied to an image forming apparatus capable of high-speed printing and high-speed copying.

A toner supplying device of the technology described herein includes: a toner density sensor for detecting a toner density in a developer tank; a first toner supplying section for supplying toner to the developer tank; a second toner supplying section for supplying toner to the first toner supplying section; and a control section, when a request to supply toner to the developer tank is made in accordance with a signal detected by the toner density sensor, for controlling the first toner supplying section and the second toner supplying section so that (i) the first toner supplying section supplies toner to the developer tank and (ii) the second toner supplying section supplies toner to the first toner supplying section.

Further, a toner supplying method of the technology described herein is a method for supplying toner from a first toner supplying section to a developer tank, and for supplying toner from a second toner supplying section to the first toner supplying section, the method, including the step of: when a shortage in toner density in the developer tank is detected, (i) causing the first toner supplying section to supply toner to the developer tank and (ii) causing the second toner supplying section to supply toner to the first toner supplying section.

According to the foregoing arrangement, the first toner supplying section supplies toner to the developer tank in cases where a shortage in toner density in the developer tank is detected, and the second toner supplying section supplies toner to the first toner supplying section in cases where a supply of toner by the first toner supplying section to the developer tank is detected. Therefore, the supply of toner from the second toner supplying section to the first toner supplying section is not carried out depending on a result of detection carried out by a remaining toner amount sensor provided for example in the first toner supplying section, but is carried out in cases where the first toner supplying section supplies toner to the developer tank.

Thus, even when the first toner supplying section has a small size and a small capacity, belated supply of toner from the second toner supplying section to the first toner supplying section is prevented, so that there is no shortage in remaining toner amount in the first toner supplying section. This makes it possible to stably supply toner from the first toner supplying section to the developer tank.

The toner supplying device may be arranged such that: the control section (a) integrates time during which the first toner supplying section is supplying toner to the developer tank and (b) causes, every time the time thus integrated reaches a first set time, the second toner supplying section to supply toner to the first toner supplying section.

According to the foregoing arrangement, by appropriately setting the first set time, it is possible to prevent toner from being accumulated near a toner inlet, via which toner is supplied from the second toner supplying section, of the first toner supplying section. That is, it is possible to supply toner from the second toner supplying section to the first toner supplying section in accordance with an amount of toner transported in the first toner supplying section.

The toner supplying device may be arranged such that: the first toner supplying section includes (i) a toner inlet via which toner is supplied from the second toner supplying section, (ii) a toner outlet via which the toner to be supplied to the first supplying section is discharged, (iii) a toner transportation path, provided in a direction so as to cross a vertical direction, which extends from the toner inlet to the toner outlet, and (iv) a toner transporting member, provided in the toner transportation path, which sequentially transports toner, dropped onto the toner transportation path via the toner inlet, to cause the toner to drop via the toner outlet.

The foregoing arrangement allows the first toner supplying section to have a thin and small structure, and therefore allows miniaturization of the toner supplying device. Further, in the first toner supplying section having the toner transportation path provided in the direction so as to cross the vertical direction, it is possible to prevent the toner transportation path from having a toner shortage region free or short of toner. This makes it possible to stably supply toner from the first toner supplying section to the developer tank.

The toner supplying device may be arranged such that: the control section (a) integrates time during which the first toner supplying section is supplying toner to the developer tank and (b) causes, every time the time thus integrated reaches a first set time, the second toner supplying section to supply toner to the first toner supplying section; the first toner supplying section includes (i) a toner inlet via which toner is supplied from the second toner supplying section, (ii) a toner outlet via which the toner to be supplied to the first supplying section is discharged, (iii) a toner transportation path, provided in a direction so as to cross a vertical direction, which extends from the toner inlet to the toner outlet, and (iv) a toner transporting member, provided in the toner transportation path, which sequentially transports toner, dropped onto the toner transportation path through the toner inlet, to cause the toner to drop via the toner outlet; and the first set time is set in accordance with time required for the toner transporting member to transport toner outward a region, which is located directly below the toner inlet, in the toner transportation path of the first toner supplying section.

The foregoing arrangement allows the first toner supplying section to have a thin and small structure, and therefore allows miniaturization of the toner supplying device. Further, in the first toner supplying section having the toner transportation path provided in the direction so as to cross the vertical direction, it is possible to prevent the toner transportation path from having a toner shortage region free or short of toner. This makes it possible to stably supply toner from the first toner supplying section to the developer tank.

The toner supplying device may be arranged such that: the second toner supplying section includes a toner bottle, containing toner therein, which is rotated to discharge the toner.

According to the foregoing arrangement, the second toner supplying section includes the toner bottle, containing the toner therein, which is rotated to discharge the toner. This makes it easy to control an amount of toner to be supplied. Thus, even in cases where the first toner supplying section is miniaturized, the second toner supplying section is always able to stably supply toner to the first toner supplying section.

The toner supplying device may be arranged so as to further include a supplying pipe, extending in an up-and-down direction, which has (i) one end connected to the toner outlet of the first toner supplying section and (ii) another end connected to the developer tank.

According to the foregoing arrangement, even in cases where such a toner supplying device that toner is supplied from the first toner supplying section to the developer tank via the supplying pipe extending in an up-and-down direction is disposed in a limited space, it is possible to stably supply an appropriate amount of toner from the first toner supplying section to the supplying pipe.

The toner supplying device may be arranged so as to further include: a display section for carrying out a display; a display control section for controlling the display section; and a remaining toner amount detecting section for detecting a remaining toner amount in the first toner supplying section, the second toner supplying section including a toner cartridge, and when the remaining toner amount detecting section has detected for a certain period of time or longer a shortage in remaining toner amount, the display control section controlling the display section to carry out a display suggesting replacement of the toner cartridge.

The foregoing arrangement allows a user to easily know when the toner cartridge should be replaced.

The embodiments and concrete examples of implementation discussed in the foregoing detailed explanation serve solely to illustrate the technical details of the technology described herein, which should not be narrowly interpreted within the limits of such embodiments and concrete examples, but rather may be applied in many variations within the spirit of the present invention, provided such variations do not exceed the scope of the patent claims set forth below.

What is claimed is:

1. A toner supplying device, comprising:

a toner density sensor for detecting a toner density in a developer tank;

first toner supplying means for supplying toner to the developer tank;

second toner supplying means for supplying toner to the first toner supplying means; and control means, when a request to supply toner to the developer tank is made in accordance with a signal detected by the toner density sensor, for controlling the first toner supplying means and the second toner supplying means so that (i) the first toner supplying means supplies toner to the developer tank and (ii) the second toner supplying means supplies toner to the first toner supplying means.

2. The toner supplying device as set forth in claim 1, wherein the first toner supplying means includes (i) a toner inlet via which toner is supplied from the second toner supplying means, (ii) a toner outlet via which the toner to be supplied to the first toner supplying means is discharged, (iii) a toner transportation path, provided in a direction so as to cross a vertical direction, which extends from the toner inlet to the toner outlet, and (iv) a toner transporting member, provided in the toner transportation path, which sequentially transports toner, dropped onto the toner transportation path via the toner inlet, to cause the toner to drop via the toner outlet.

3. The toner supplying device as set forth in claim 2, wherein the toner transporting member is a toner transporting screw which is rotated to stir and transport the toner.

4. The toner supplying device as set forth in claim 1, further comprising:

display means for carrying out a display;

display control means for controlling the display means; and remaining toner amount detecting means for detecting a remaining toner amount in the first toner supplying means, the second toner supplying means including a toner cartridge, and when the remaining toner amount detecting means has detected for a certain period of time or longer a shortage in remaining toner amount, the display control means controlling the display means to carry out a display suggesting replacement of the toner cartridge.

5. A developing device, comprising a toner supplying device as set forth in claim 1.

6. An image forming apparatus, comprising a developing device as set forth in claim 5.

7. A toner supplying device, comprising:

a toner density sensor for detecting a toner density in a developer tank;

first toner supplying means for supplying toner to the developer tank;

second toner supplying means for supplying toner to the first toner supplying means; and control means for controlling the first toner supplying means and the second toner supplying means so that (i) the first toner supplying means supplies toner to the developer tank when a request to supply toner to the developer tank is made in accordance with a signal detected by the toner density sensor and (ii) the second toner supplying means supplies toner to the first toner supplying means when a supply of toner by the first toner supplying means to the developer tank is detected.

8. The toner supplying device as set forth in claim 7, wherein the control means (a) integrates time during which the first toner supplying means is supplying toner to the developer tank and (b) causes, every time the time thus integrated reaches a first set time, the second toner supplying means to supply toner to the first toner supplying means.

9. The toner supplying device as set forth in claim 7, wherein the first toner supplying means includes (i) a toner inlet via which toner is supplied from the second toner supplying means, (ii) a toner outlet via which the toner to be supplied to the first toner supplying means is discharged, (iii) a toner transportation path, provided in a direction so as to cross a vertical direction, which extends from the toner inlet to the toner outlet, and (iv) a toner transporting member, provided in the toner transportation path, which sequentially transports toner, dropped onto the toner transportation path via the toner inlet, to cause the toner to drop via the toner outlet.

10. The toner supplying device as set forth in claim 9, wherein the second toner supplying means includes a toner bottle, containing toner therein, which is rotated to discharge the toner.

11. The toner supplying device as set forth in claim 9, further comprising:

a supplying pipe, extending in an up-and-down direction, which has (i) one end connected to the toner outlet of the first toner supplying means and (ii) another end connected to the developer tank.

12. The toner supplying device as set forth in claim 7, wherein:

the control means (a) integrates time during which the first toner supplying means is supplying toner to the developer tank and (b) causes, every time the time thus integrated reaches a first set time, the second toner supplying means to supply toner to the first toner supplying means;

the first toner supplying means includes (i) a toner inlet via which toner is supplied from the second toner supplying means, (ii) a toner outlet via which the toner to be supplied to the first toner supplying means is discharged, (iii) a toner transportation path, provided in a direction so as to cross a vertical direction, which extends from the toner inlet to the toner outlet, and (iv) a toner transporting member, provided in the toner transportation path, which sequentially transports toner, dropped onto the toner transportation path via the toner inlet, to cause the toner to drop via the toner outlet; and the first set time is set in accordance with time required for the toner transporting member to transport toner outward a region, which is located directly below the toner inlet, in the toner transportation path of the first toner supplying means.

13. The toner supplying device as set forth in claim 7, further comprising:

display means for carrying out a display;

display control means for controlling the display means; and remaining toner amount detecting means for detecting a remaining toner amount in the first toner supplying means, the second toner supplying means including a toner cartridge, and when the remaining toner amount detecting means has detected for a certain period of time or longer a shortage in remaining toner amount, the display control means controlling the display means to carry out a display suggesting replacement of the toner cartridge.

14. A developing device, comprising a toner supplying device as set forth in claim 7.

15. An image forming apparatus, comprising a developing device as set forth in claim 14.

16. A method for supplying toner from first toner supplying means to a developer tank, and for supplying toner from second toner supplying means to the first toner supplying means, the method, comprising the step of:

when a shortage in toner density in the developer tank is detected, (i) causing the first toner supplying means to supply toner to the developer tank and (ii) causing the second toner supplying means to supply toner to the first toner supplying means.

17. A method for supplying toner from first toner supplying means to a developer tank, and for supplying toner from second toner supplying means to the first toner supplying means, the method, comprising the steps of:

when a shortage in toner density in the developer tank is detected, causing the first toner supplying means to supply toner to the developer tank; and when a supply of toner by the first toner supplying means to the developer tank is detected, causing the second toner supplying means to supply toner to the first toner supplying means.

* * * * *

UNITED STATES PATENT AND TRADEMARK OFFICE

CERTIFICATE OF CORRECTION

PATENT NO. : 7,668,470 B2
APPLICATION NO. : 11/700891
DATED : February 23, 2010
INVENTOR(S) : Tsuji et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 541 days.

Signed and Sealed this

Seventh Day of December, 2010

David J. Kappos

David J. Kappos
*Director of the United States Patent and Trademark Office*